US010663147B2

(12) United States Patent
Jurik et al.

(10) Patent No.: US 10,663,147 B2
(45) Date of Patent: May 26, 2020

(54) HEAT PROTECTION AND HOMOGENIZING SYSTEM FOR A LUMINAIRE

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 16/118,114

(22) Filed: Aug. 30, 2018

(65) Prior Publication Data

US 2018/0372304 A1 Dec. 27, 2018

Related U.S. Application Data

(60) Provisional application No. 62/553,295, filed on Sep. 1, 2017.

(51) Int. Cl.
*F21V 14/04* (2006.01)
*F21V 29/10* (2015.01)
(Continued)

(52) U.S. Cl.
CPC ..... *F21V 14/04* (2013.01); *F21S 10/007* (2013.01); *F21V 7/0066* (2013.01); *F21V 7/08* (2013.01);
(Continued)

(58) Field of Classification Search
CPC ..... F21V 14/04; F21V 7/0066; F21V 7/08
See application file for complete search history.

(56) References Cited

U.S. PATENT DOCUMENTS

2009/0187234 A1 7/2009 Meyer et al.
2010/0245279 A1* 9/2010 Kubis ..... H05B 37/034 345/173
(Continued)

FOREIGN PATENT DOCUMENTS

CN 104302967 A 1/2015
EP 1215437 A2 6/2002
(Continued)

OTHER PUBLICATIONS

Notice of Allowance dated Mar. 12, 2019; U.S. Appl. No. 16/179,491, filed Nov. 2, 2018; 12 pages.
(Continued)

*Primary Examiner* — Alexander H Taningco
*Assistant Examiner* — Pedro C Fernandez
(74) *Attorney, Agent, or Firm* — Conley Rose, P.C.; Grant Rodolph; Brooks W Taylor

(57) ABSTRACT

An automated luminaire and method are presented. The luminaire includes a light source, an ellipsoidal reflector, an optical device, and a controller. The ellipsoidal reflector produces an emitted light beam and moves along an optical axis. The optical device receives the emitted light beam and produces either a modified light beam or an unmodified light beam. The controller determines whether the optical device is producing the modified or unmodified light beam. If the optical device is producing the modified light beam, the controller automatically moves the ellipsoidal reflector to a selected position to reduce an effect on the optical device of a hotspot in the emitted light beam. The controller may move the ellipsoidal reflector to a selected position relative to the light source in response to determining that the optical device is producing the modified light beam.

18 Claims, 15 Drawing Sheets

(51) Int. Cl.

| | |
|---|---|
| ***F21V 21/15*** | (2006.01) |
| ***F21V 7/00*** | (2006.01) |
| ***F21S 10/00*** | (2006.01) |
| ***F21V 7/08*** | (2006.01) |
| ***F21V 14/02*** | (2006.01) |
| *F21W 131/406* | (2006.01) |

(52) U.S. Cl.
CPC ..... *F21V 14/02* (2013.01); *F21V 21/15* (2013.01); *F21V 29/10* (2015.01); *F21W 2131/406* (2013.01)

(56) References Cited

U.S. PATENT DOCUMENTS

2013/0094215 A1* 4/2013 Jurik ..... F21S 10/007 362/296.01
2014/0160744 A1* 6/2014 Wimberly ..... F21V 13/04 362/232
2015/0092422 A1 4/2015 Jurik et al.
2017/0090115 A1 3/2017 Jurik et al.

FOREIGN PATENT DOCUMENTS

WO 2012138773 A2 10/2012
WO 2015168218 A2 11/2015

OTHER PUBLICATIONS

Jurik, Pavel, et al.; U.S. Appl. No. 16/179,491, filed Nov. 2, 2018; Title: Heat Protection and Homogenizing System for a Luminaire; 43 pages.
European Extended Search Report; Application No. 18191997.8; dated Nov. 26, 2018; 8 pages.
Chinese Office Action; Application No. 201811023072.2; dated Sep. 20, 2019; 26 pages.

* cited by examiner

HEAT PROTECTION AND HOMOGENIZING SYSTEM FOR A LUMINAIRE

CROSS-REFERENCE TO RELATED APPLICATIONS

This application claims priority to U.S. Provisional Application No. 62/553,295 filed Sep. 1, 2017 by Pavel Jurik, et al. entitled, "Heat Protection and Homogenizing System for a Luminaire", which is incorporated by reference herein as if reproduced in its entirety.

TECHNICAL FIELD

The disclosure generally relates to an automated luminaire, specifically to a heat protection and homogenization system in an automated luminaire.

BACKGROUND

Luminaires with automated and remotely controllable functionality are well known in the entertainment and architectural lighting markets. Such products are commonly used in theatres, television studios, concerts, theme parks, night clubs and other venues. Such a luminaire may provide control over the direction the luminaire is pointing and thus the position of the light beam on the stage or in the studio. This directional control may be provided via control of the luminaire's orientation in two orthogonal axes of rotation usually referred to as pan and tilt. Some products provide control over other parameters such as the intensity, color, focus, beam size, beam shape and beam pattern. The beam pattern may be provided by a stencil or slide called a gobo which may be a steel, aluminum or etched glass pattern.

SUMMARY

In one embodiment, an automated luminaire includes a light source, an ellipsoidal reflector, an optical device, and a controller. The ellipsoidal reflector is optically coupled to the light source and produces an emitted light beam. The ellipsoidal reflector has an optical axis and moves relative to the light source along its optical axis. The optical device receives the emitted light beam and produces either a modified light beam or an unmodified light beam. The controller is configured to determine whether the optical device is producing the modified or unmodified light beam and, in response to determining that the optical device is producing the modified light beam, to move the ellipsoidal reflector to a selected position relative to the light source.

In another embodiment, a method for use in an automated luminaire includes determining whether an optical device of the automated luminaire is producing a modified or unmodified light beam from an emitted light beam received by the optical device. The method further includes reducing an effect on the optical device of a hotspot in the emitted light beam by moving an ellipsoidal reflector to a selected position in response to determining that the optical device is producing the modified light beam.

In yet another embodiment, an automated luminaire includes a light source, an optical device, and a controller. The light source produces an emitted light beam and includes an ellipsoidal reflector and a short arc discharge lamp. The lamp is fixedly mounted with its arc positioned near a first focus of the ellipsoidal reflector. The light source has an optical axis and is configured to move along the optical axis. The optical device receives the emitted light beam and produces either a modified light beam or an unmodified light beam. The controller determines whether the optical device is producing the modified or unmodified light beam and, if the optical device is producing the modified light beam, moves the light source along the optical axis to a selected position relative to the optical device. The position is selected to locate a second focus of the ellipsoidal reflector in front of or behind the optical device.

BRIEF DESCRIPTION OF THE DRAWINGS

For a more complete understanding of this disclosure, reference is now made to the following brief description, taken in conjunction with the accompanying drawings in which like reference numerals indicate like features.

DETAILED DESCRIPTION

Preferred embodiments are illustrated in the figures, like numerals being used to refer to like and corresponding parts of the various drawings.

Disclosed herein is an automated luminaire (or fixture), specifically the design and operation of a heat protection and homogenization system for use within an automated luminaire utilizing a light source with an intense hotspot such that the luminaire is capable of producing a narrow light beam in a first mode, and, in a second mode, capable of producing a wide, even, wash beam or projecting gobos without damaging the gobos or compromising the narrow beam performance of the first mode.

The optical systems of automated luminaires may be designed such that a very narrow output beam is produced, so that the units may be used with long throws or for almost parallel light laser like effects. Such optics may be called 'Beam' optics. In fixtures with a large light source, such a narrow beam may be formed using a large output lens with a large separation between the lens and the luminaire's gobos. In other such fixtures, an output lens with a short focal length may be positioned closer to the gobos.

Having a large separation with a large lens can cause the luminaire to be large and unwieldy and may make automation of the fixture's pan and tilt movement more difficult. In some systems, a preferred solution is a closer and smaller lens with a short focal length. In other systems a Fresnel lens may be used as a front lens, providing the same focal length with a lighter, molded glass lens having multiple circumferential facets. Fresnel lenses can provide a good match to the focal length of an equivalent plano-convex lens, however the image projected by a Fresnel lens may be soft edged and fuzzy and not provide as sharp an image as may be desired when projecting gobos or patterns.

Figure 1:
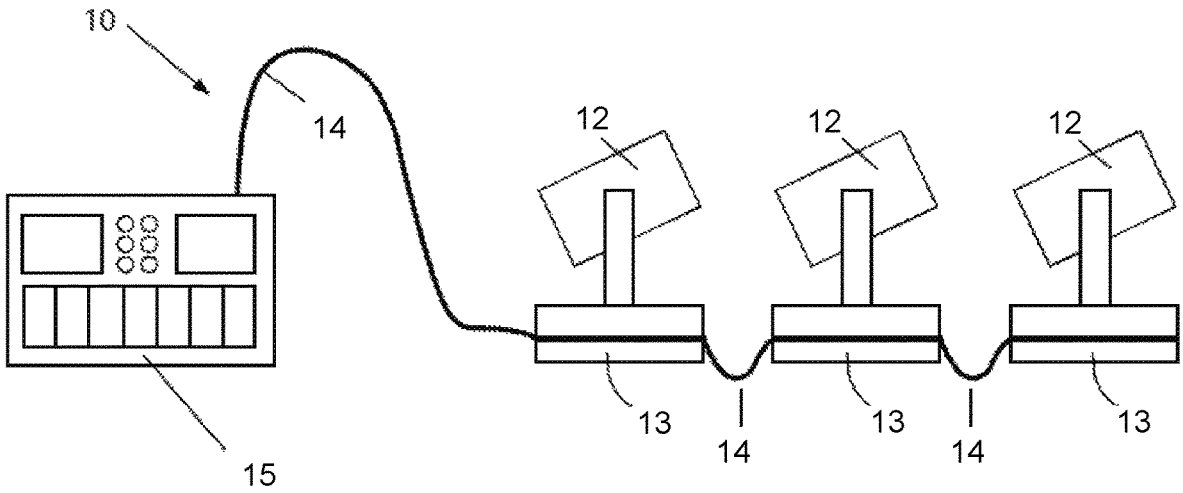
FIG. 1 illustrates a multiparameter automated luminaire system.

FIG. 1 illustrates a multiparameter automated luminaire system 10. The luminaire system 10 includes a plurality of multiparameter automated luminaires 12 which each contains an on-board light source (not shown), light modulation devices, electric motors coupled to mechanical drive systems, and control electronics (not shown). In addition to being connected to mains power either directly or through a power distribution system (not shown), the luminaires 12 are connected in series or in parallel via a data link 14 to one or more control desks 15. The luminaire system 10 may be controlled by an operator using the control desk 15. Control of an individual automated luminaire 12 is typically effectuated by electromechanical devices within the luminaire 12 and electronic circuitry 13 including firmware and software within the control desk 15 and/or the luminaire 12. The luminaire 12 and the electronic circuitry 13 may also be referred to collectively as a fixture. In many of the figures herein, important parts like electromechanical components such as motors and electronic circuitry including software and firmware and some hardware are not shown in order to simplify the drawings. Persons of skill in the art will recognize where these parts have been omitted.

Figure 2:
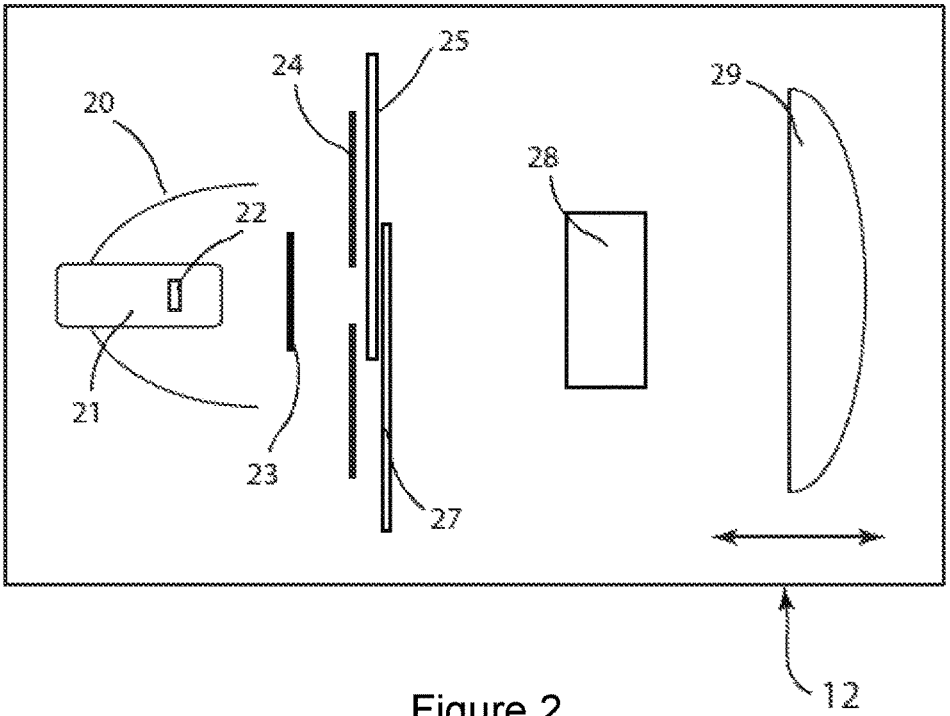
FIG. 2 illustrates an automated luminaire.

FIG. 2 illustrates an automated luminaire 12. A lamp 21 includes a light source 22 which emits light. The light is reflected and controlled by a reflector 20 through one or more of a static hot mirror 23, aperture or imaging gate 24, and optical devices 25 and 27. The optical devices 25 and 27 may include one or more of dichroic color filters, effects glass and other optical devices. The optical devices 25 and 27 may be imaging components and may include gobos, rotating gobos, irises, and/or framing shutters. A final output beam may be transmitted through focusing lens 28 and output lens 29. Output lens 29 may be a short focal length glass lens or equivalent Fresnel lens as described above. The optical devices 25 and 27, focusing lens 28, and/or output lens 29 may be moved along the optical axis of the automated luminaire 12 to provide focus and/or beam angle adjustment for the imaging components. Static hot mirror 23 may protect the optical devices 25 and 27 from high infrared energy in the light beam, and typically comprises a glass plate with a thin film dichroic coating designed to reflect long wavelength infra-red light radiation, thus allowing only the shorter wavelength, visible light to remain in the light beam. However, in such designs, the static hot mirror 23 is always in position, modifying the light beam.

Some lamps 21 have extremely small light sources 22. Such light sources may have a very short arc gap, on the order of 1 millimeter (mm), between two electrodes as the light-producing means. Such lamps are well-suited for producing a very narrow beam, as their source etendue is low. Furthermore, the size of the lenses and optical devices to collimate the light from such a small source can be substantially reduced. However, the short arc and small light source coupled with a short focal length, and thus large light beam angles, of the reflector can result in a light beam with large amounts of energy concentrated in the central region, known as a hotspot. This intense central energy region is not ideal for producing a large even wash of light, and can damage or destroy elements of optical devices 25 and 27. In particular, glass gobos and projection patterns may be damaged by such an intense central hotspot. The light energy may damage the surface coatings and materials of the gobos.

Optical systems according to the present disclosure are capable of producing a narrow light beam in a first mode, and also, in a second mode, of producing a wide wash beam or of projecting gobos without damaging the gobos.

Figure 3:
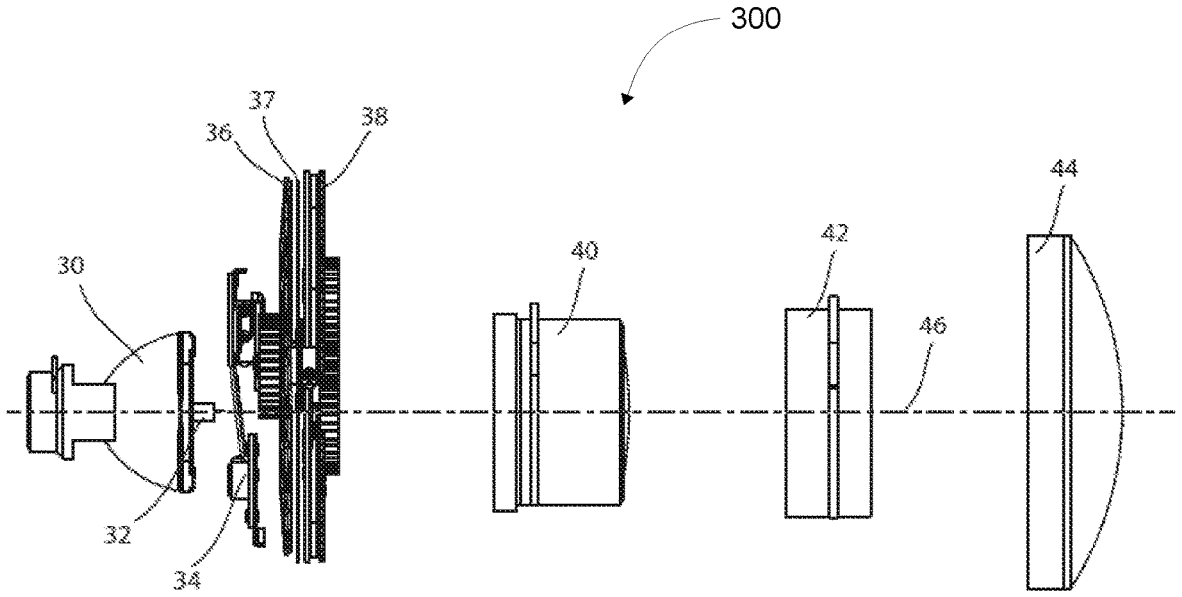
FIG. 3 presents a schematic side view of an optical system according to the disclosure.

FIG. 3 presents a schematic side view of an optical system 300 according to the disclosure. The optical system 300 includes a light source 32 mounted in a fixed position within reflector 30 (the combination of light source 32 and reflector 30 may be referred to as a combined light source). Light source 32 may be a short arc discharge lamp with arc length of approximately 1 mm, and reflector 30 may be positioned near a first focus of the ellipsoidal glass reflector 30. The combination of a short arc light source and an ellipsoidal reflector produces a light beam towards a second focus of the ellipsoidal reflector. Such a beam typically has a very high energy beam center, or hotspot. The beam also produces a poor wide beam pattern when trying to use the luminaire as a wash light.

In the optical system 300, the light beam emitted by the light source 32 and reflector 30 passes through a heat protection and homogenization system (compensation module) 34 and the resulting compensated light beam passes through optical devices color system 36, static gobo system 37, and rotating gobo system 38. In other embodiments, one or more of systems 36, 37, and 38 may be omitted. The light beam then continues through lenses 40, 42, and 44, which may each individually or collectively be moveable along optical axis 46 so as to alter one or more of the focus, beam angle, and/or zoom of the light beam produced by the optical system 300.

Optical elements such as static gobo system 37 and rotating gobo system 38 may contain gobos or patterns that can be damaged by an intense hotspot. Such gobos may have a glass substrate with layers of aluminum, thin film coatings or other means for creating an image layer on the glass. The energy gradient from a light beam with an intense hotspot may damage these coatings, or crack or melt the glass. Similarly, devices such as irises or framing shutters may be damaged by the hotspot. The compensation module 34 provides protection for optical elements by introducing either a diffuser or hot mirror into the light beam, when such protection is required. The compensation module 34 also provides for the removal of both diffuser and hot mirror from the beam when no optical element protection is required and an unmodified light beam is desired.

The compensation module 34 protects optical elements that are sensitive to a beam hotspot by automatically introducing a diffuser into the light path whenever a gobo or other heat sensitive element is inserted into the light beam. This diffuser may also be automatically removed from the light beam when all hotspot sensitive or heat sensitive devices are removed from the light beam, and may be replaced with a hot mirror. In some circumstances, an operator may manually control the compensation module 34 so that the diffuser is across the light beam when it is desired to produce a wide, smooth light beam for use as a wash light. In such circumstances, lenses 40, 42, and 44 may be adjusted to produce a wide beam angle or zoom, and the resultant beam will be smooth and flat with no intense bright central hotspot. In other circumstances, the operator may manually control the compensation module 34 so that the hot mirror is across the light beam when it is desired to produce a very tight, narrow beam of light. In such circumstances the central hotspot is useful to the optics and it is desirable to remove all homogenization or diffusion such that the light beam is as narrow and sharp as possible. In still other circumstances, the operator may manually control the compensation module 34 so that neither the diffuser nor the hot mirror is across the light beam.

Figure 4:
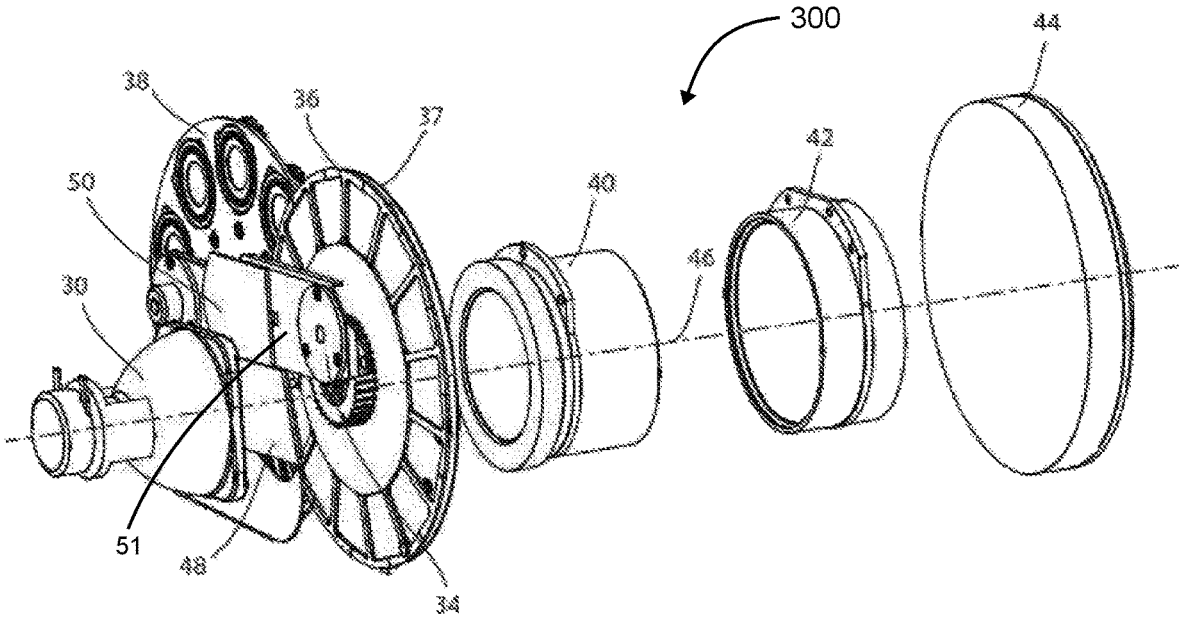
FIG. 4 presents a schematic isometric view of the optical system of FIG. 3 with the compensation module in a first configuration.

FIG. 4 presents a schematic isometric view of the optical system 300 of FIG. 3 with the compensation module 34 in a first configuration. The compensation module 34 includes an arm 51 to which are mounted hot mirror 48 and diffuser 50. The hot mirror 48 and the diffuser 50 may be referred to as compensation elements. Hot mirror 48, which is positioned in the light beam in FIG. 4, is a filter that may be fabricated as one or more thin film coatings on glass, which reflects infra-red and other long wavelength energy, while allowing visible light to pass through. Diffuser 50, which is positioned out of the light beam in FIG. 4, is a homogenizing filter. The diffuser 50 may be manufactured as a frosted glass, lenticular glass, bead lens or filter, particulate frost filter, microlens array, or other kind of homogenizing filter. The diffuser 50 acts to spread out or dissipate any central hotspot in the light beam, providing a flatter, more diffuse beam that will not damage optical devices 36, or gobos mounted on the static gobo system 37 and the rotating gobo system 38, and will produce a smoother wash light beam.

Figure 5:
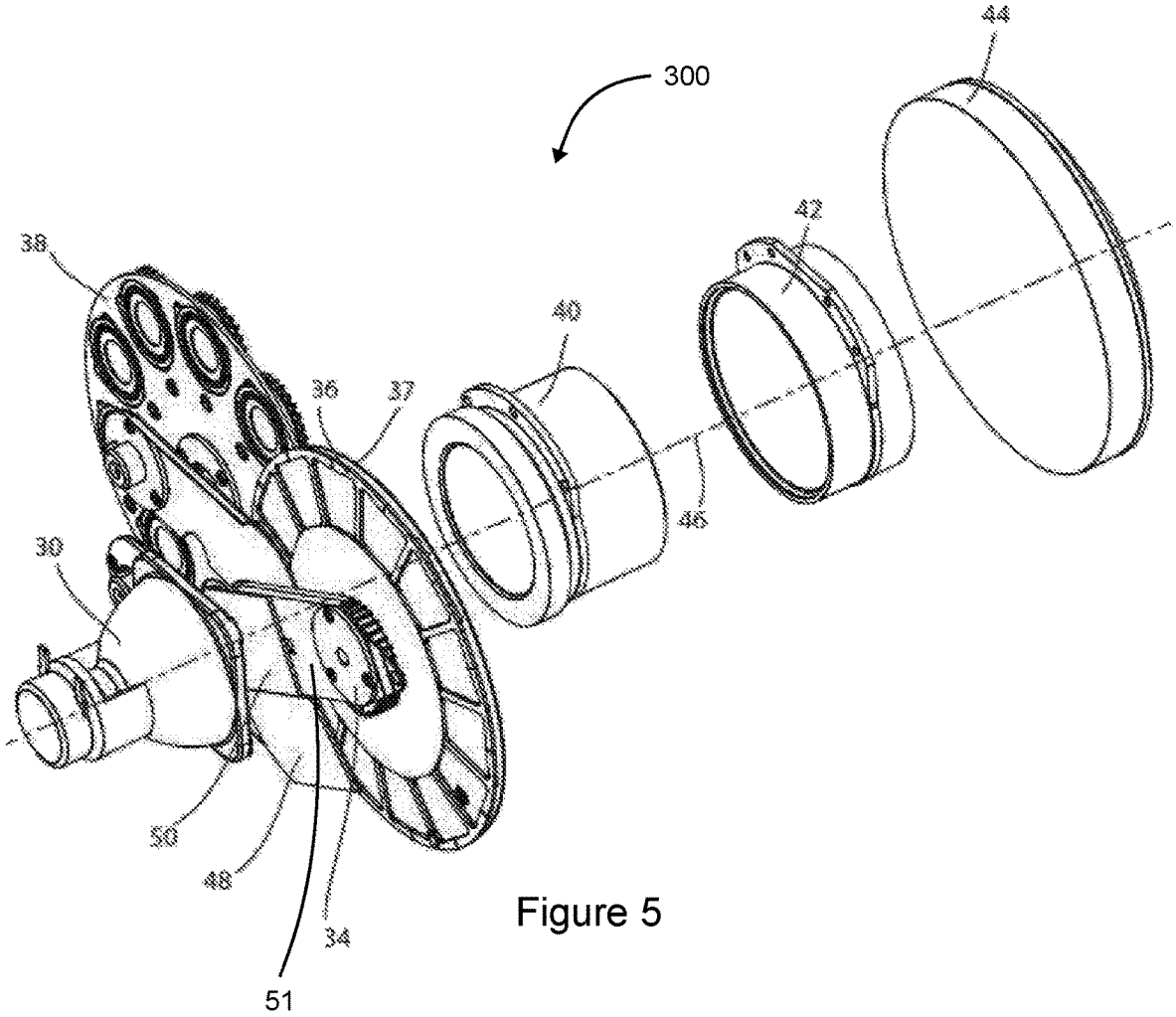
FIG. 5 illustrates an isometric view of the optical system of FIG. 3 with the compensation module in a second configuration.

FIG. 5 presents a schematic isometric view of the optical system 300 of FIG. 3 with the compensation module 34 in a second configuration. In this figure the arm 51 has been rotated so that the diffuser 50 is in the optical path and the hot mirror 48, is removed from the optical path. The compensation module 34 may be rapidly rotated from a first position where the hot mirror 48 is in the optical path to a second position where the diffuser 50 is in the optical path. The means for this movement may be as shown in the figures using the pivoted arm 51 driven through gears and a stepper motor (not shown). In other embodiments, movement of the compensation elements may be through other mechanical means such as linear actuators, lead screw, rack and pinion drive, direct drive motors, servo motors, solenoids or other mechanical actuators. In some embodiments, the hot mirror 48 and the diffuser 50 may be moved by separate arms or other actuators, permitting either or both to be inserted or removed from the light beam, as desired.

Figure 6:
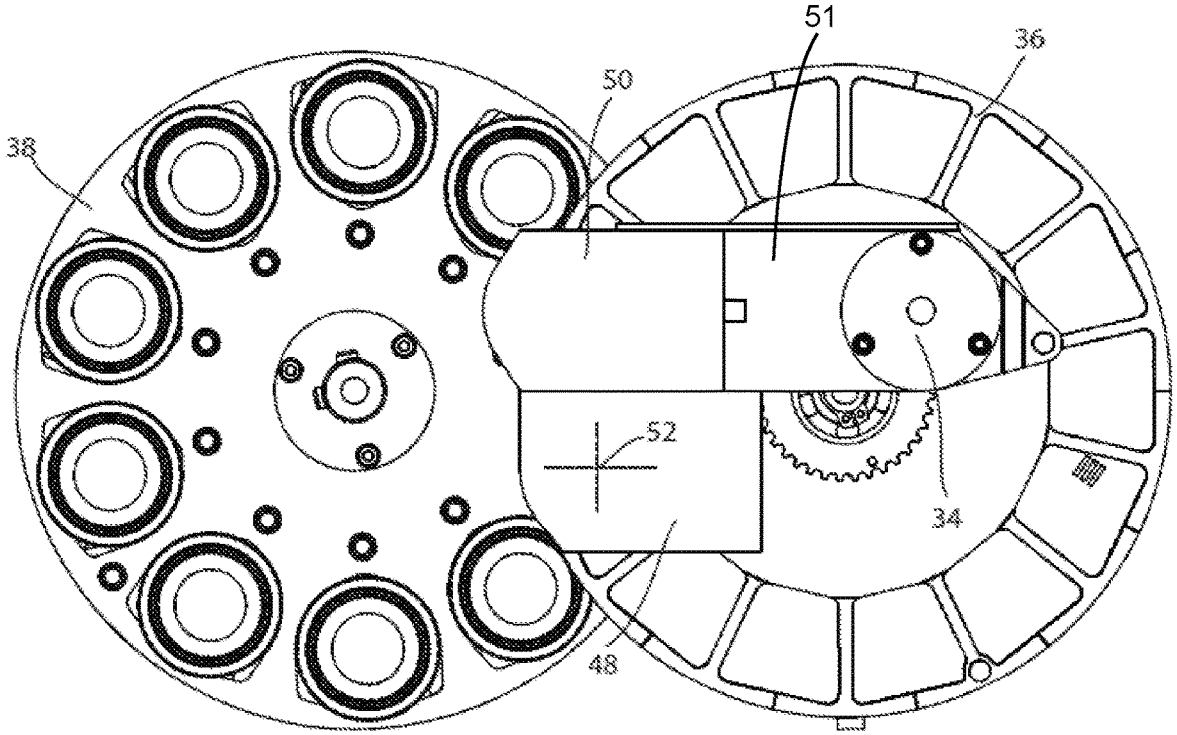
FIG. 6 shows a cross-sectional view of the optical system of FIG. 3 with the compensation module in the first configuration.
Figure 7:
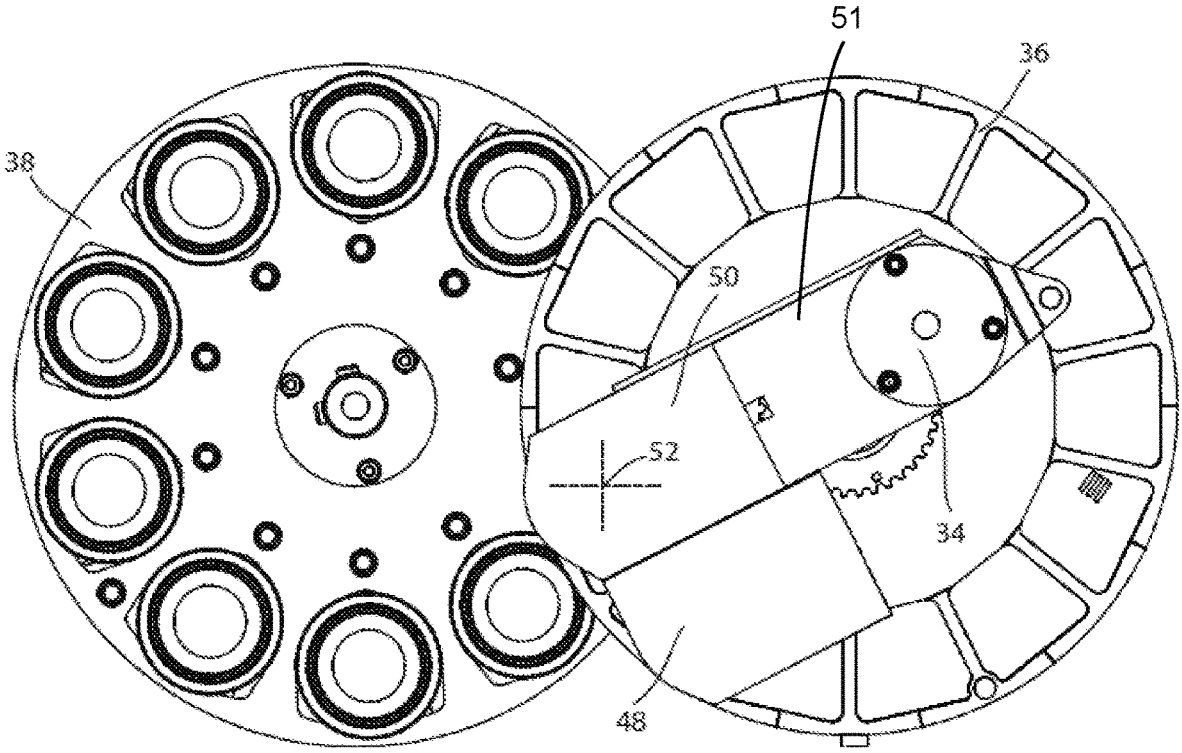
FIG. 7 shows a cross-sectional view of the optical system of FIG. 3 with the compensation module in the second configuration.

FIGS. 6 and 7 shows cross-sectional views of the optical system 300 of FIG. 3 with the compensation module 34 in the first and second configurations, respectively. In FIG. 6, the hot mirror 48 is in the optical path, as shown by the optical axis marker 52. In FIG. 7, the arm 51 has been rotated so that diffuser 50 is in the optical path, again as shown by the optical axis marker 52.

Figure 8:
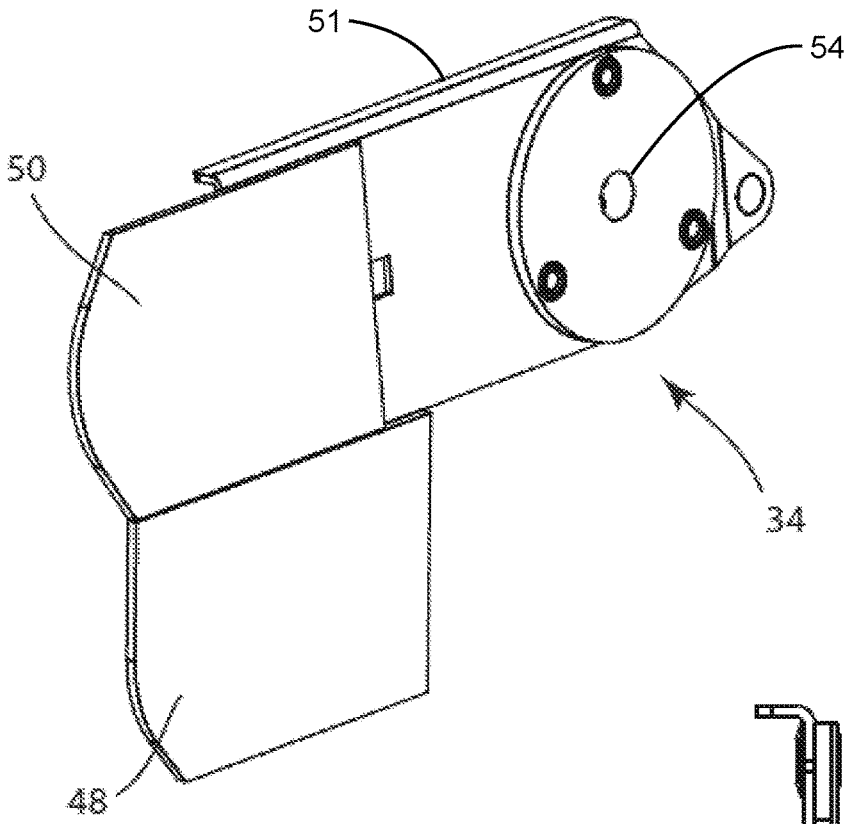
FIG. 8 presents an isometric view of the compensation module of the optical system of FIG. 3.
Figure 9:
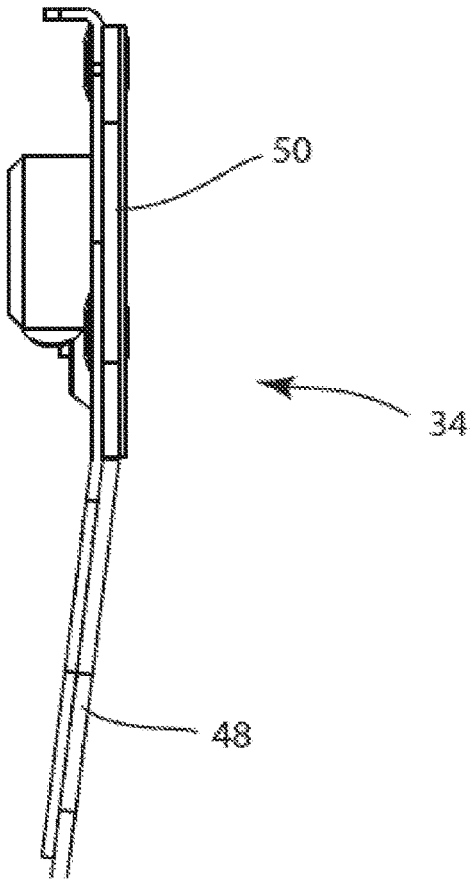
FIG. 9 presents a side view of the compensation module of the optical system of FIG. 3.

FIG. 8 presents an isometric view of the compensation module 34 of the optical system 300 of FIG. 3. FIG. 9 presents a side view of the compensation module 34 of the optical system 300 of FIG. 3. In this embodiment, the hot mirror 48 is mounted at an angle to the optical axis 46, which lies parallel to an axis of rotation 54 of the arm 51. By angling hot mirror 48, the infra-red and other long wavelength energy reflected by hot mirror 48 is not sent back directly into the lamp, potentially overheating it. Instead, that energy is deflected to one side, away from the light source 32.

The diffuser 50 may be constructed of a single substrate as shown in FIGS. 8 and 9, or may comprise two or more layers. In some embodiments, the diffuser 50 may be a single substrate with a hot mirror coating on one of its surfaces so as to also act as a hot mirror as well as a diffuser. In other embodiments, the diffuser 50 may comprise two or more substrates, of which at least a first substrate is a diffuser or homogenizer and at least a second substrate is a hot mirror.

Figure 10:
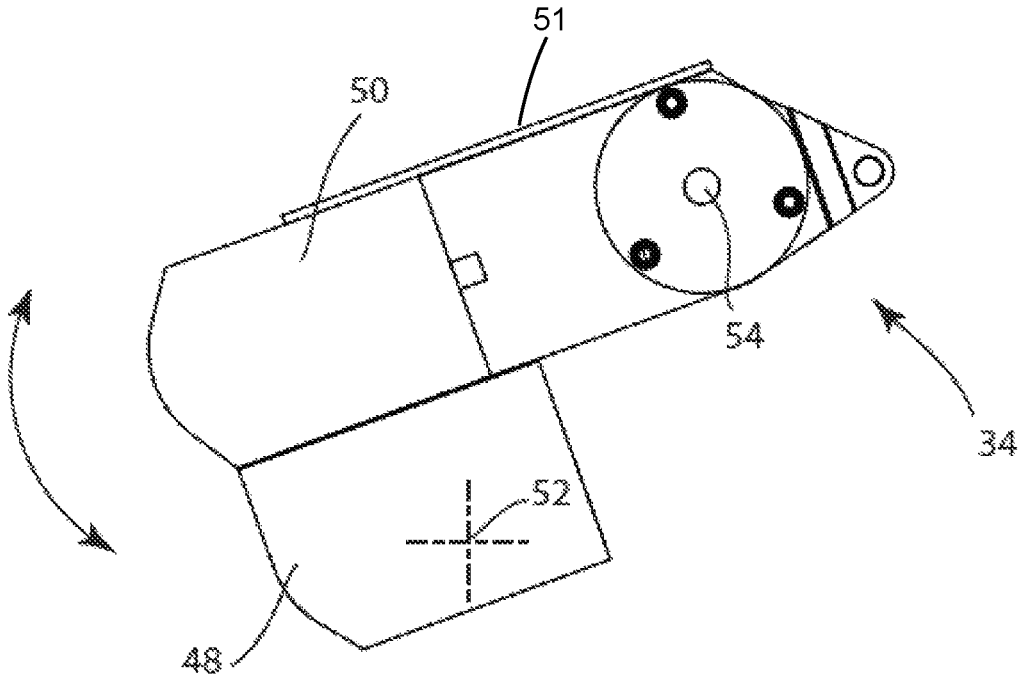
FIG. 10 presents a view of the compensation module in a first position of the first configuration.
Figure 11:
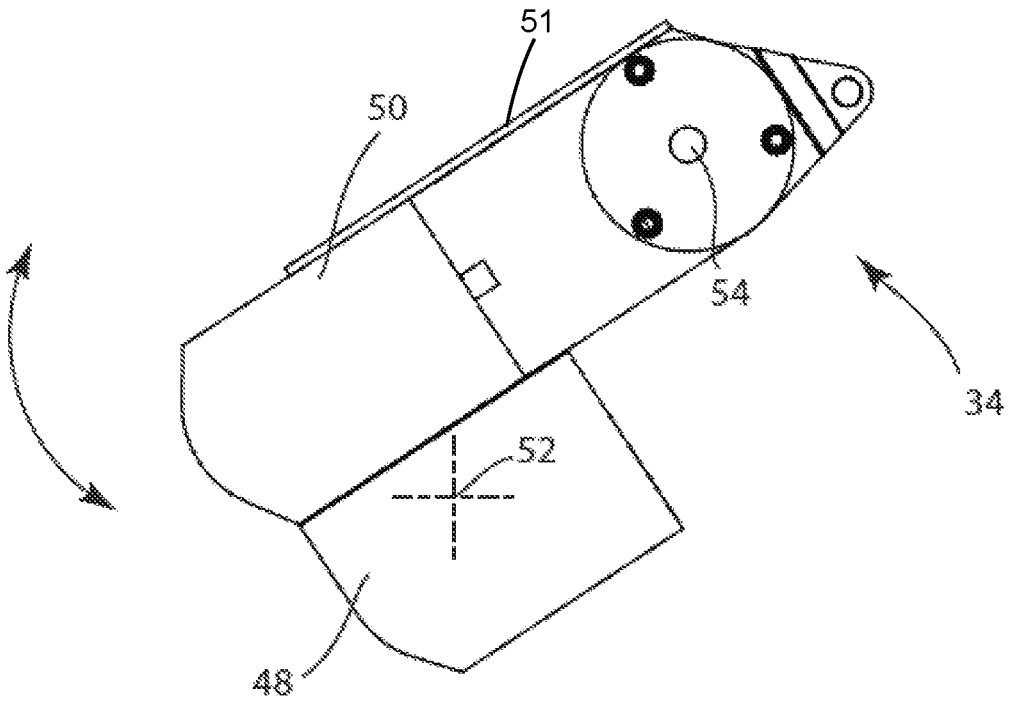
FIG. 11 presents a view of the compensation module in a second position of the first configuration.

In a further embodiment, the compensation module 34 may continually oscillate between two positions on either or both of the hot mirror 48 or the diffuser 50 while they are positioned in the beam. In some circumstances the compensation elements themselves could be sensitive to the damaging effects of the hotspot it is being used to mitigate. In such circumstances, the compensation elements may be continually moved back and forth across the light beam, exposing different portions of the active compensation element to the hotspot and spreading the heat energy over a larger area of the compensation element. FIGS. 10 and 11 illustrate this technique.

FIG. 10 presents a view of the compensation module 34 in a first position of the first configuration. A first portion of the hot mirror 48 is on the optical axis 46, as shown by the marker 52. FIG. 11 presents a view of the compensation module 34 in a second position of the first configuration. In FIG. 11, compensation module 34 has been rotated and a second portion of the hot mirror 48 is on the optical axis 46, as shown by the optical axis marker 52. In a preferred embodiment, this oscillation is modulated at rates of approximately 0.5 hertz (Hz) in a sinusoidal pattern, when position is graphed against time. In other embodiments, other movement rates, oscillation frequencies, or position wave patterns may be employed.

The diffuser 50 may be similarly protected by oscillating the arm 51. In other embodiments, color wheels could be modulated in a similar manner. However in such an embodiment, the color filters on the color wheel would have to be large enough to allow for a sufficient range of oscillation motion. The range of motion necessary, in the case of a color wheel may be different for different colors.

Figure 12:
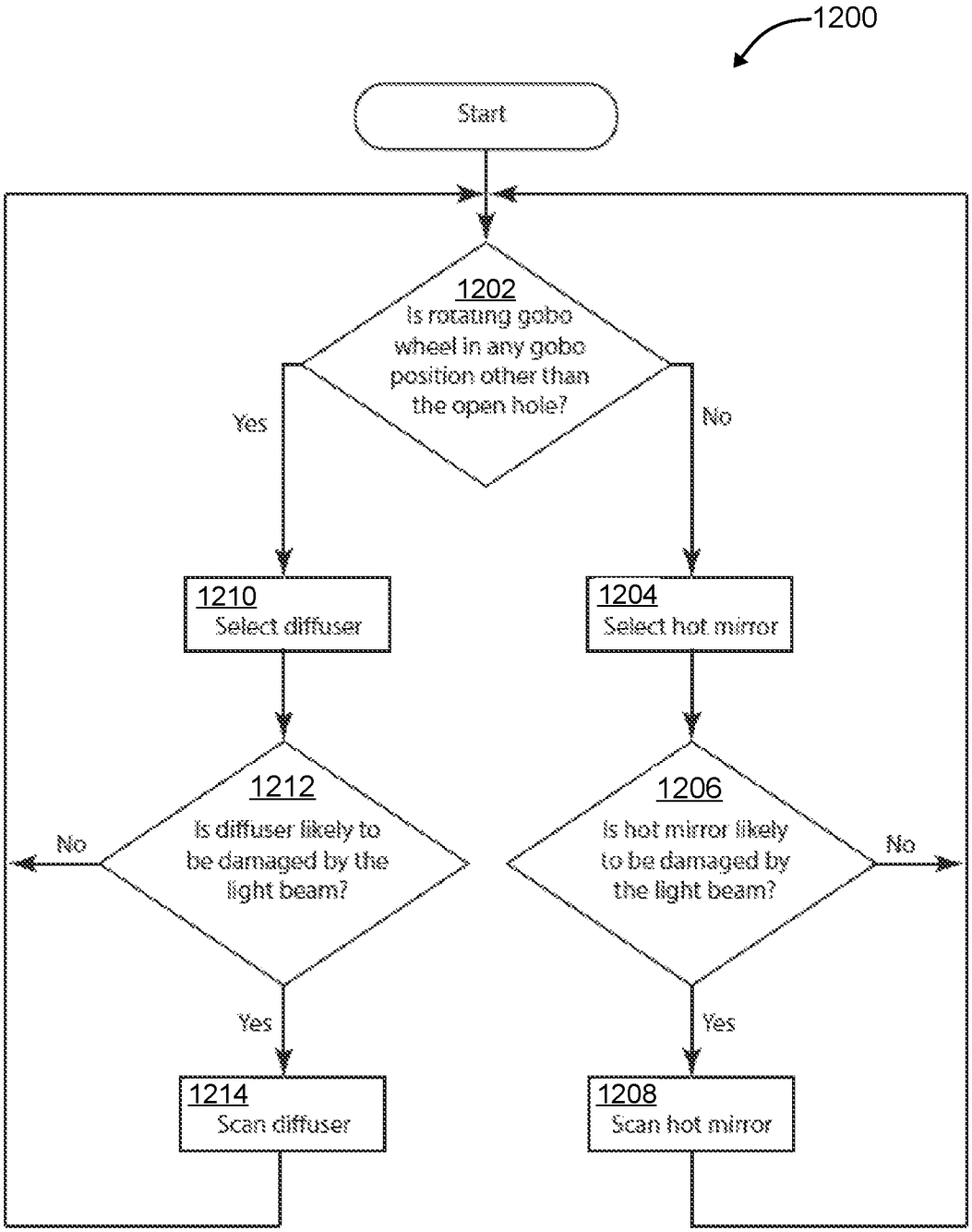
FIG. 12 presents a flow chart of a process of controlling a heat protection and homogenization system according to the disclosure.

FIG. 12 presents a flow chart 1200 of a process of controlling a heat protection and homogenization system according to the disclosure. The flow chart 1200 describes logic for protecting heat sensitive optical elements of an automated luminaire. The process described by the flow chart 1200 may be performed by the control system described below with reference to FIG. 25.

When the automated luminaire is on, the system monitors whether the luminaire is producing a modified light beam, for example, by placing a heat sensitive optical element in the light beam (step 1202). If the system determines that the luminaire is not producing a modified light beam (or if the beam is modified by an optical element that is not heat sensitive), then the hot mirror 48 is selected to engage the light beam. (step 1204). The system then monitors the operation of the luminaire to determine whether the status of the luminaire may cause risk of damage to the hot mirror 48 (step 1206). If so, the hot mirror 48 is scanned or oscillated as described with reference to FIGS. 10 and 11 (step 1208) and the system returns to step 1202 to look for a change in light beam modification status. In determining a risk of damage to the hot mirror 48, the system may consider, how long the hot mirror 48 has been engaged, how long it is expected to be engaged given preprogramed lighting instructions, fixture temperature, ambient temperature, and/or other factors. In other embodiments, the logic can dictate that whenever the luminaire optical elements are repositioned to produce an unmodified light beam, the hot mirror 48 is selected to engage the light beam and, if needed, is scanned.

If the system determines that the luminaire is producing a modified light beam (step 1202), then the diffuser 50 is selected to engage the light beam (step 1210). The system then monitors the operation of the luminaire to determine whether the status of the luminaire may cause risk of damage to the diffuser 50 (step 1212). If so, the diffuser 50 is scanned as described with reference to FIGS. 10 and 11 (step 1214). In determining a risk of damage, the system may consider, how long the diffuser 50 has been engaged, how long it is expected to be engaged given preprogramed lighting instructions, fixture temperature, ambient temperature, and/or other factors. In other embodiments, the logic can dictate that whenever the luminaire optical elements are repositioned to produce a modified light beam, the diffuser 50 is selected to engage the light beam and, if needed, is scanned.

Figure 13:
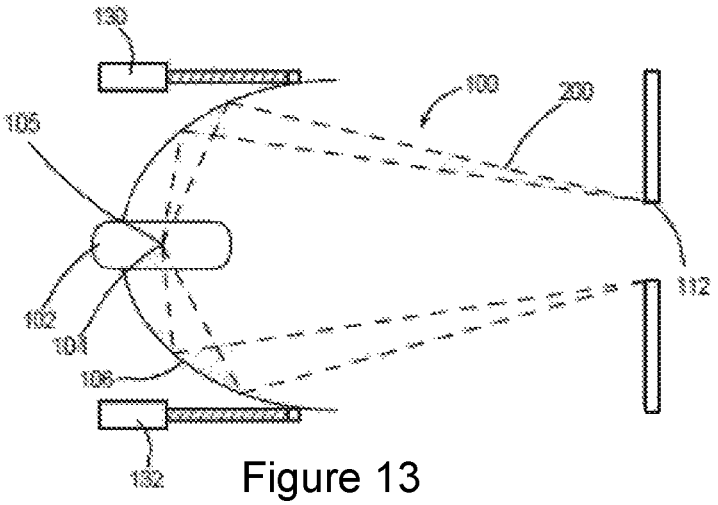
FIG. 13 illustrates a remotely actuated reflector according to the disclosure, with the reflector in a first position.

FIG. 13 illustrates a remotely actuated reflector optical system 100 according to the disclosure, with an ellipsoidal reflector 106 in a first position. The optical system 100 includes a light source 102 having an emission point 104, the ellipsoidal reflector 106 configured to reflect light emitted by the light source 102, and motors 130 and 132 configured to move the ellipsoidal reflector 106 along its optical axis relative to the light source 102. Other shaped reflectors are contemplated for other embodiments. In FIG. 13 the ellipsoidal reflector 106 is positioned relative to the light source 102 with the emission point 104 of light source 102 at the first focal point 105 of the ellipsoidal reflector 106. In this first position, emitted light beam 200 is directed through aperture 112 with a slightly peaky beam distribution.

Figure 14:
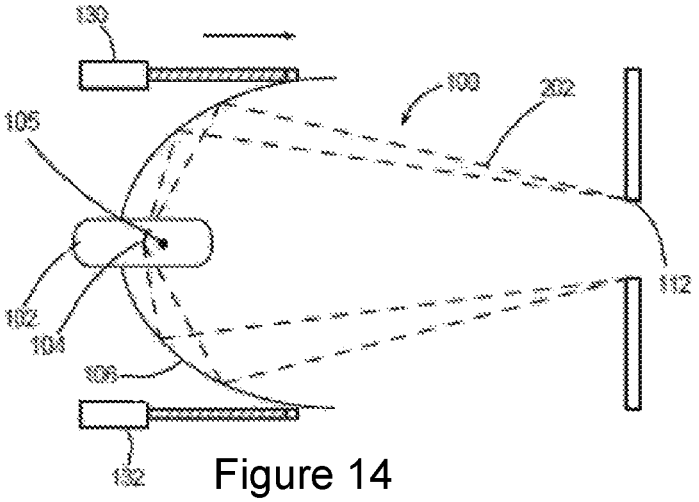
FIG. 14 illustrates the remotely actuated reflector of FIG. 13, with the reflector in a second position.

FIG. 14 illustrates the remotely actuated reflector optical system 100 of FIG. 13, with the ellipsoidal reflector 106 in a second position. Motors 130 and 132 have been activated to move the ellipsoidal reflector 106 forward to position the emission point 104 of light source 102 behind the first focal point 105. In this second position, emitted light beam 202 is directed through aperture 112 with a peakier distribution and increased hotspot.

Figure 15:
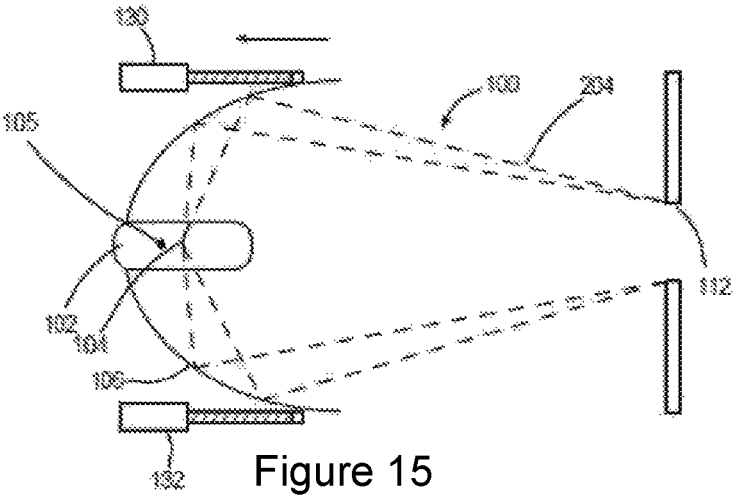
FIG. 15 illustrates the remotely actuated reflector of FIG. 13, with the reflector in a third position.

FIG. 15 illustrates the remotely actuated reflector optical system 100 of FIG. 13, with the ellipsoidal reflector 106 in a third position. Motors 130 and 132 have been activated to move the ellipsoidal reflector 106 rearwards to position the emission point 104 of light source 102 in front of the first focal point 105. In this third position, emitted light beam 204 is directed through aperture 112 with a flatter distribution and reduced hotspot.

In other embodiments more or fewer than two motors may be used to control the position of the ellipsoidal reflector 106. In still other embodiments, stepper motors, servo motors, linear actuators, or other suitable mechanical actuators may be used to move the ellipsoidal reflector 106. The movement of the ellipsoidal reflector 106 in the preferred embodiment is continuous, providing multiple positions between an extreme forward position and an extreme rearward position. In other embodiments, the movement may be more stepwise with two or more positions selectable by an operator through the automated lighting system in which the luminaire is a part.

Figure 16:
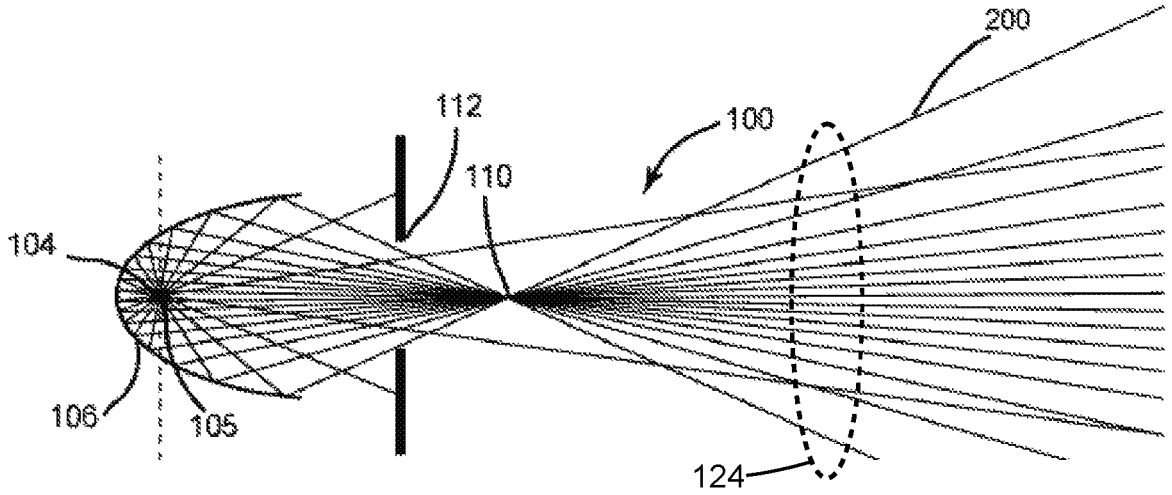
FIG. 16 presents a ray trace diagram of the optical system of FIG. 13.

FIG. 16 presents a ray trace diagram of the optical system 100 of FIG. 13, with the ellipsoidal reflector 106 in the first position. The emission point 104 of the light source 102 (for clarity, illustrated in FIGS. 16-18 as an idealized point source) is positioned at the first focal point 105 of the ellipsoidal reflector 106. Light is collected by the ellipsoidal reflector 106 and directed through the aperture 112 towards a second focal point 110. The light beam 200 then continues towards further downstream optical elements (not shown) or towards a light target.

The light beam 200 may be directed through a series of optical devices such as a rotating gobo wheel containing multiple patterns or gobos, a static gobo wheel containing multiple patterns or gobos, an iris, color mixing systems utilizing subtractive color mixing flags, color wheels, framing shutters, graphic wheels, animation wheels, frost and diffusion filters, and beam shapers. The light beam 200 may then pass through an objective lens system, which may provide variable beam angle or zoom functionality, as well as the ability to focus on various components of the optical system before emerging as the required light beam.

The light beam 200 of light has a distribution 124. With the light source and ellipsoidal reflector 106 in the configuration shown in FIG. 16, the output light distribution 124 is produced with more light in the center than around the edges, and the intensity reduces gradually from the center to the edges of the beam. The shape of this light distribution may follow a bell curve shape and may be referred to as having a 'hotspot'. An operator may control the intensity of this hotspot and the flatness of the field by manually moving the light source of a prior art optical system along the optical axis to position its emission point in front of or behind the first focal point of the reflector during lamp installation.

However, as may also be seen in FIG. 16, at locations in the light beam 200 that are nearer to or farther from the light source and ellipsoidal reflector 106 than the second focal point 110 (for example, at the aperture 112), the intensity of the hotspot is diminished. The energy of the light beam 200 is spread over a wider diameter at these nearer/farther and the intensity at the center of the light beam 200 is less damaging than at the second focal point 110.

Optical systems according to the disclosure provide remote control of the position of the reflector relative to the light source. As a result, field flatness becomes a dynamic operational control that an operator may use during a performance to dynamically adjust the beam to a desired profile at any moment. In one embodiment, the position of the light source is fixed and the ellipsoidal reflector may be moved backwards and forwards relative to that light source along its optical axis.

Figure 17:
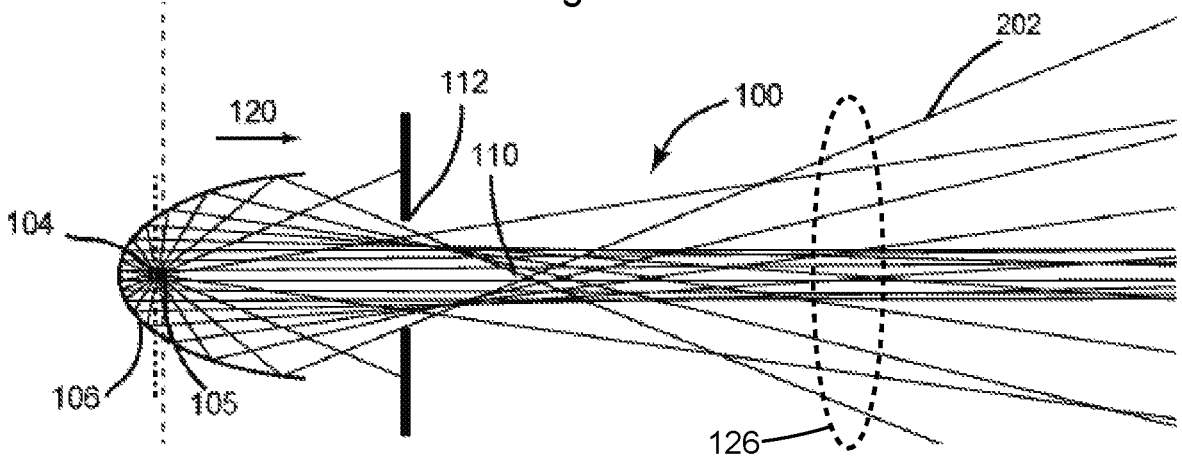
FIG. 17 presents a ray trace diagram of the optical system of FIG. 14.

FIG. 17 presents a ray trace diagram of the optical system 100 of FIG. 13, with the ellipsoidal reflector 106 in the second position. The ellipsoidal reflector 106 has been moved forward along the optical axis as shown by arrow 120 and the emission point 104 is positioned further back than the first focal point 105 of the ellipsoidal reflector 106. Light beams still pass through aperture 112, however they are not directed through the second focal point 110 of the ellipsoidal reflector 106. Instead they are directed generally towards a point further along the optical axis than the second focal point 110. In this second position of the ellipsoidal reflector 106, the distribution 126 of the light beam 202 is less flat and the central hotspot is more pronounced than in the light beam 200 shown in FIG. 16. Such a beam distribution may be advantageous for producing aerial beam effects.

Figure 18:
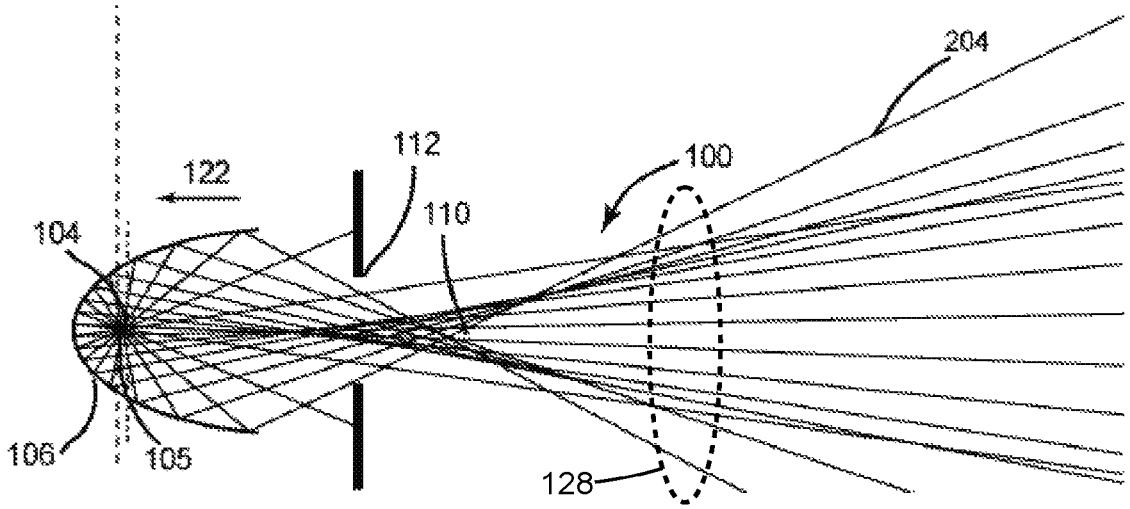
FIG. 18 presents a ray trace diagram of the optical system of FIG. 15.

FIG. 18 presents a ray trace diagram of the optical system 100 of FIG. 13, with the ellipsoidal reflector 106 in the third position. The ellipsoidal reflector 106 has been moved rearward along the optical axis, as shown by arrow 122, and the emission point 104 is positioned further forward than the first focal point 105 of the ellipsoidal reflector 106. Light beams still pass through aperture 112, however they are now directed generally towards a point closer along the optical axis than the first focal point 105. In this third position of the ellipsoidal reflector 106, the distribution 128 of the light beam 204 is flatter and the central hotspot is less pronounced, that is, the center of light beam 204 has a lower intensity than the center of light beam 200, shown in FIG. 16. Such a flat beam, with a reduced intensity hotspot, may be advantageous for projecting gobos, where a flat field may be desirable. As discussed above, a pronounced central hotspot may damage optical devices such as gobos, dichroic filters, prisms and other heat sensitive items. When such optical devices are in use, the flat field position of the reflector may be used to avoid heat-related damage. In some embodiments according to the disclosure, a control system automatically moves the reflector to the flat field position when an optical device that could be damaged by the hotspot is inserted into the beam.

Figure 19:
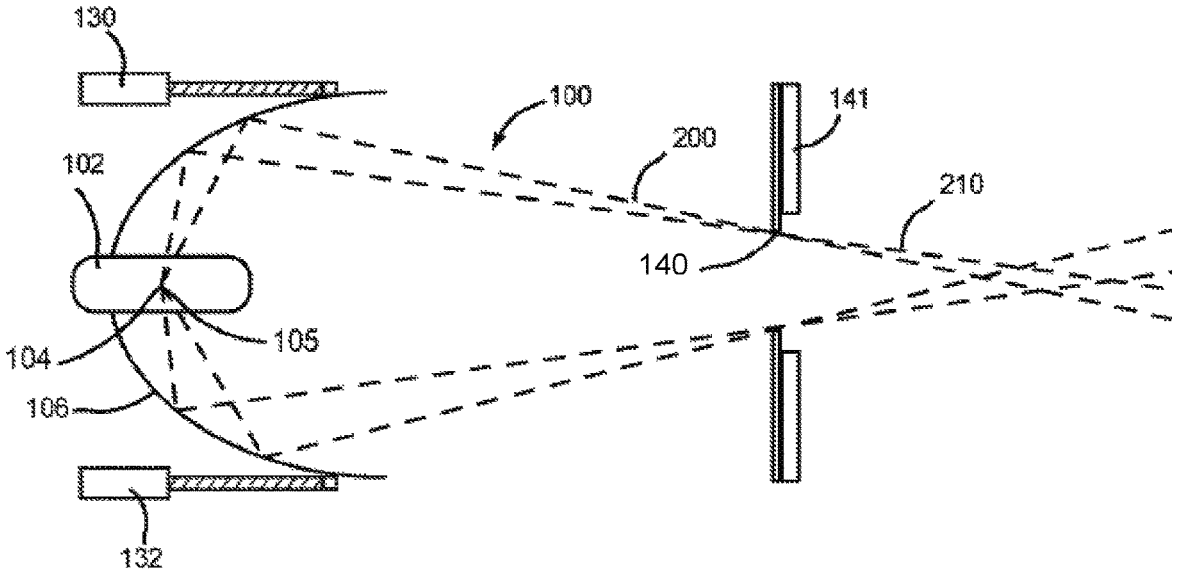
FIG. 19 illustrates an optical system according to the disclosure with a reflector and a variable iris in a first configuration.
Figure 20:
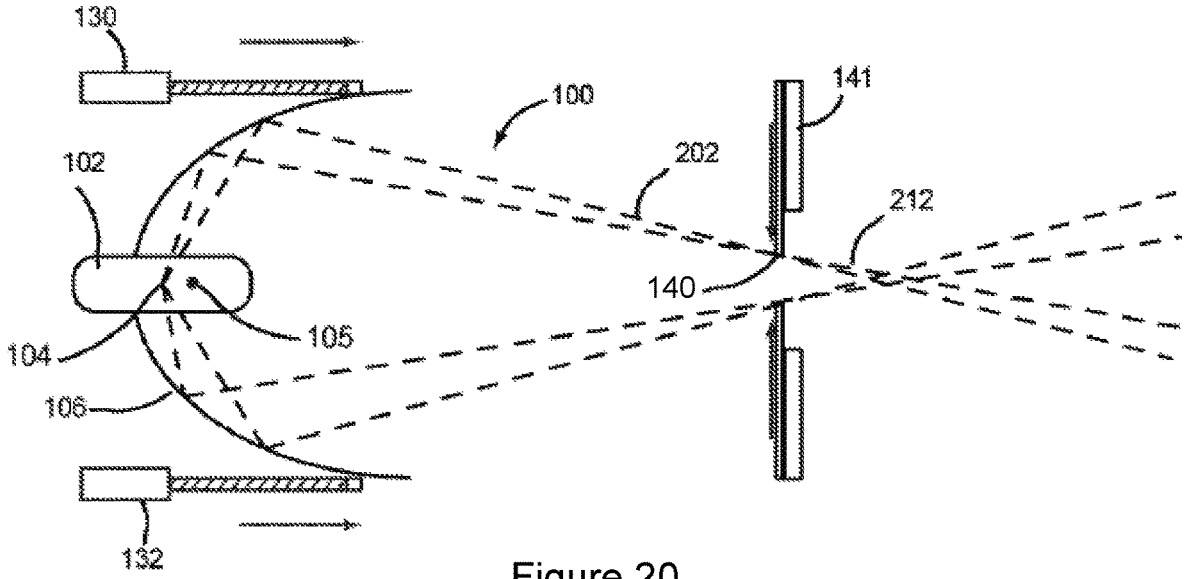
FIG. 20 illustrates the optical system of FIG. 19 with the reflector and the variable iris in a second configuration.
Figure 21:
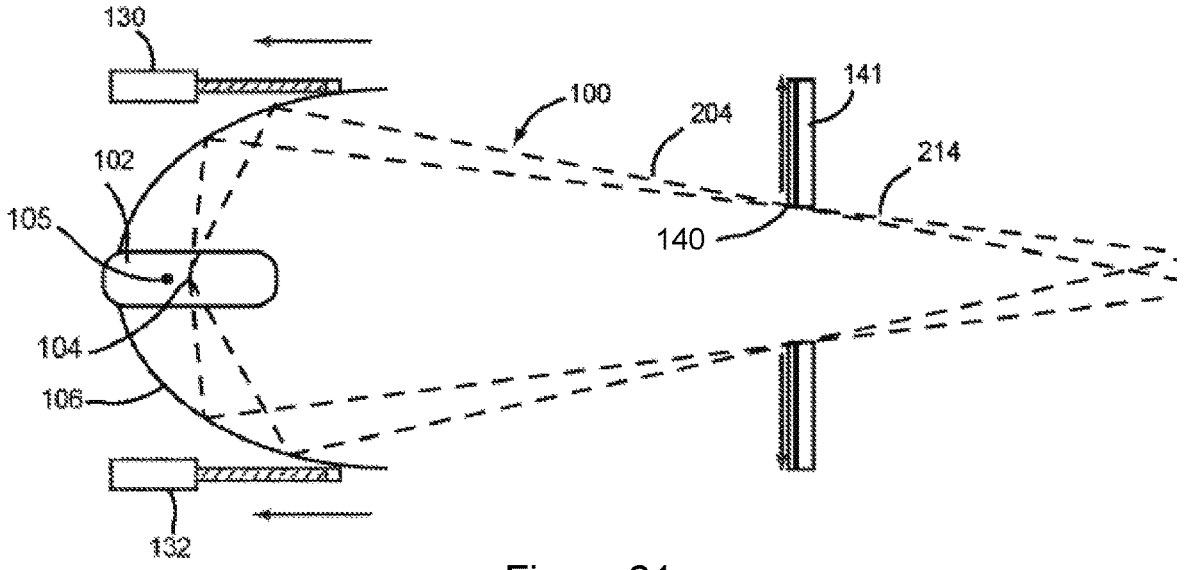
FIG. 21 illustrates the optical system of FIG. 19 with the reflector and the variable iris in a third configuration.

FIGS. 19, 20, and 21 illustrate an optical system 100 according to the disclosure where a position of the ellipsoidal reflector 106 may be based on an opening or closing of a variable iris 140 to provide a desired amount or characteristic of light through the iris 140. FIG. 19 illustrates an optical system 100 according to the disclosure with a ellipsoidal reflector 106 and an iris 140 in a first configuration. The iris 140 is mounted to a bulkhead 141. The ellipsoidal reflector 106 is positioned with the emission point 104 of the light source 102 at the first focal point 105 of the ellipsoidal reflector 106. In this configuration, light beam 200 is directed through the iris 140 with a slightly peaky distribution 210. As described with reference to FIG. 16, the iris 140 is located closer to the light source 102 and the ellipsoidal reflector 106 than the second focus of the ellipsoidal reflector 106, and the energy of the light beam 200 is spread across a larger area at the iris 140 than at the second focus of the ellipsoidal reflector 106.

FIG. 20 illustrates the optical system 100 of FIG. 19 with the ellipsoidal reflector 106 and variable iris 140 in a second configuration. The iris 140 has been stopped down to a smaller size, producing a modified beam with a smaller diameter. If the configuration of light source 102 and ellipsoidal reflector 106 were left unchanged from the first configuration, then a large amount of light from the light source 102 and ellipsoidal reflector 106 would impact on the iris 140 and not pass through the smaller central aperture. However, as shown in FIG. 20, motors 130 and 132 are activated in a first direction and ellipsoidal reflector 106 is moved forwards. In this configuration of the ellipsoidal reflector 106, the emission point 104 of the light source 102 is positioned behind the first focal point 105 of the ellipsoidal reflector 106. In this second configuration, light is directed in a narrower beam with more light passing through the center of the beam (an increased hotspot 212) and an increased amount of light passes through the iris 140.

FIG. 21 illustrates the optical system 100 of FIG. 19 with the ellipsoidal reflector 106 and the variable iris 140 in a third configuration. The iris 140 has been opened up to a larger size. If the configuration of light source 102 and ellipsoidal reflector 106 were left unchanged from the first configuration, then the outside edge of the aperture in the iris 140 would be illuminated at a low level. However, motors 130 and 132 are activated in a second direction and ellipsoidal reflector 106 is moved rearwards so that the emission point 104 of the light source 102 is positioned in front of the first focal point 105 of the ellipsoidal reflector 106. In this third configuration, light is directed in a wider, flatter beam with light distributed (214) across the whole aperture in the iris 140, and an increased amount of light passes through the outside edge of the aperture in the iris 140.

The iris 140 provides a variable aperture. In other embodiments, a variable aperture may be provided by a gobo wheel having gobos with apertures of differing diameters.

In a further embodiment, the movement of motors 130 and 132 may be coupled to a motor actuating the iris 140. In such an embodiment, as the iris 140 is opened and closed and its aperture size changes, the position of ellipsoidal reflector 106 is correspondingly adjusted to optimally position the ellipsoidal reflector 106 relative to the light source 102 so that a maximal light output is directed through the aperture in the iris 140. For example, as an operator reduces a size of the iris 140 aperture, motors 130 and 132 may be simultaneously actuated to move the ellipsoidal reflector 106 forwards, directing more light through the smaller aperture. Conversely, as an operator increases a size of the iris 140 aperture, motors 130 and 132 may be simultaneously actuated to move the ellipsoidal reflector 106 rearwards, to better fill the larger aperture.

The coupling of the movement of the iris 140 and the ellipsoidal reflector 106 may be any kind of coupling understood in the art. In some embodiments, the coupling could be a mechanical coupling, where a single motor or motors drives the movement of both the iris 140 and the ellipsoidal reflector 106 through linkages or gearing. In other embodiments, separate motors may be used to actuate the iris 140 and the ellipsoidal reflector 106, and the separate motors are coupled electrically and fed with a common electrical signal. In still other embodiments, separate motors actuate the ellipsoidal reflector 106 and the iris 140, firmware or software controls the motors independently, and the motors are coupled via a motor control system.

Figure 22:
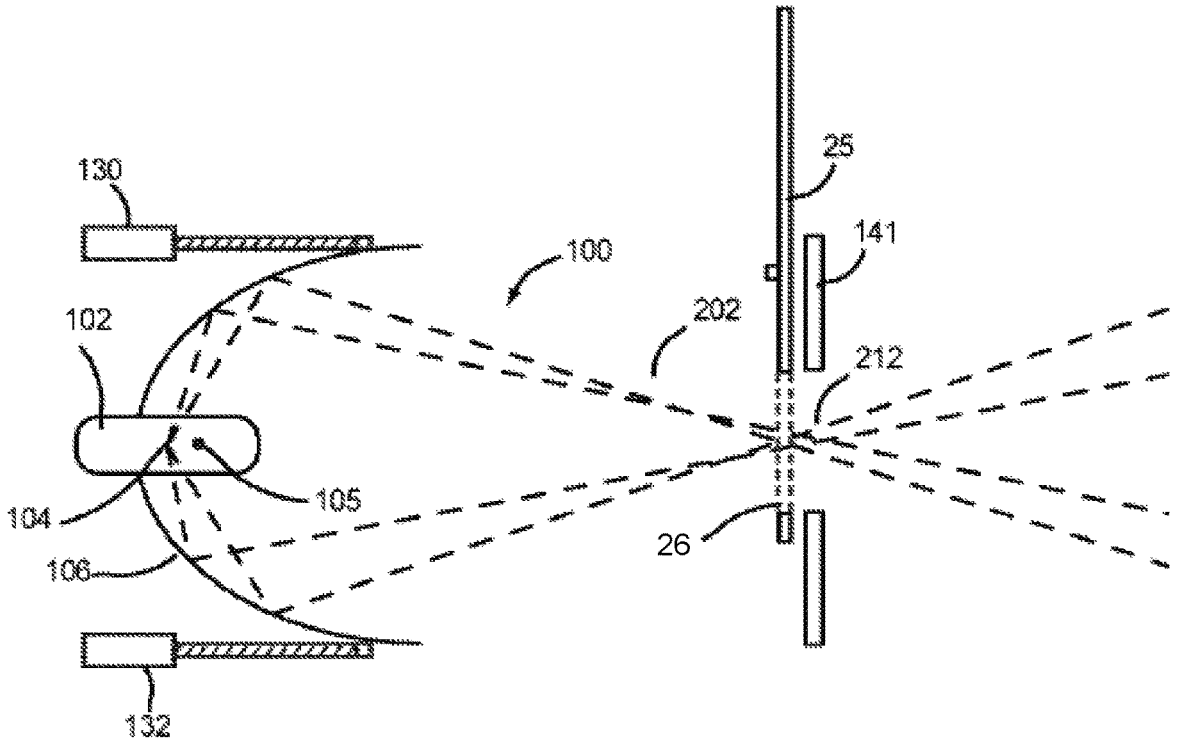
FIG. 22 shows an optical system according to the disclosure with a reflector and a gobo wheel in a first configuration.
Figure 23:
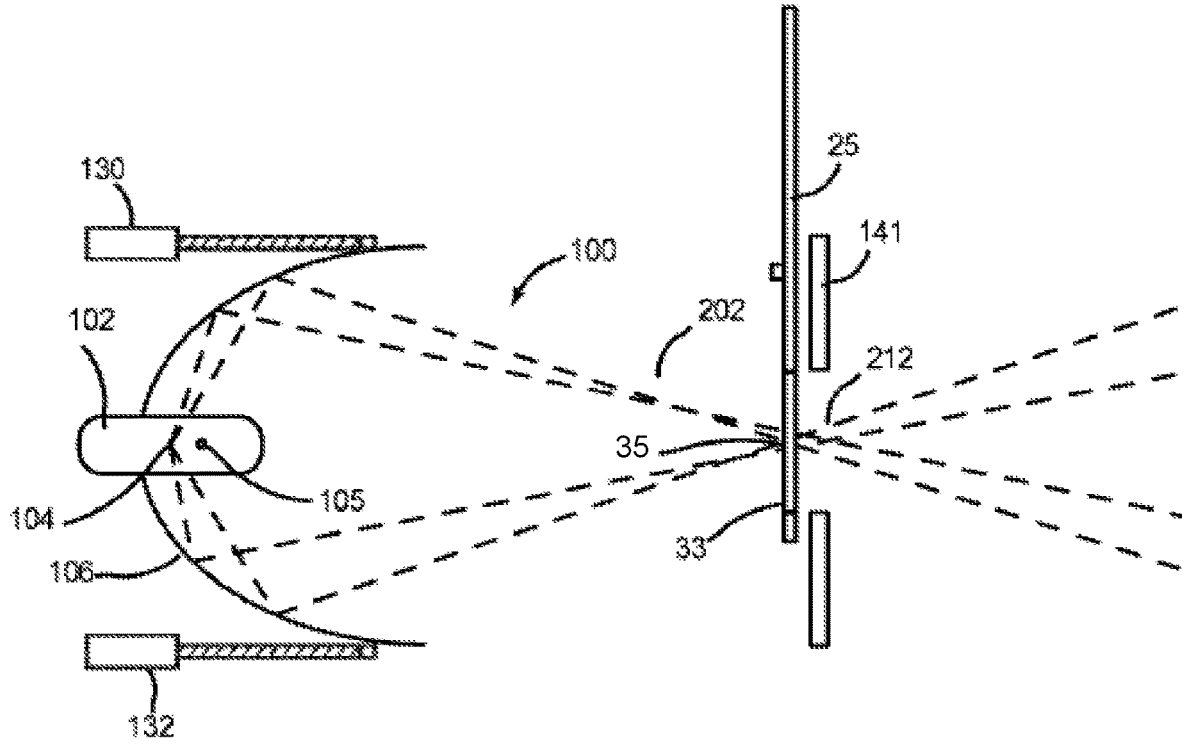
FIG. 23 shows the optical system of FIG. 22 with the reflector and the gobo wheel in a second configuration.
Figure 24:
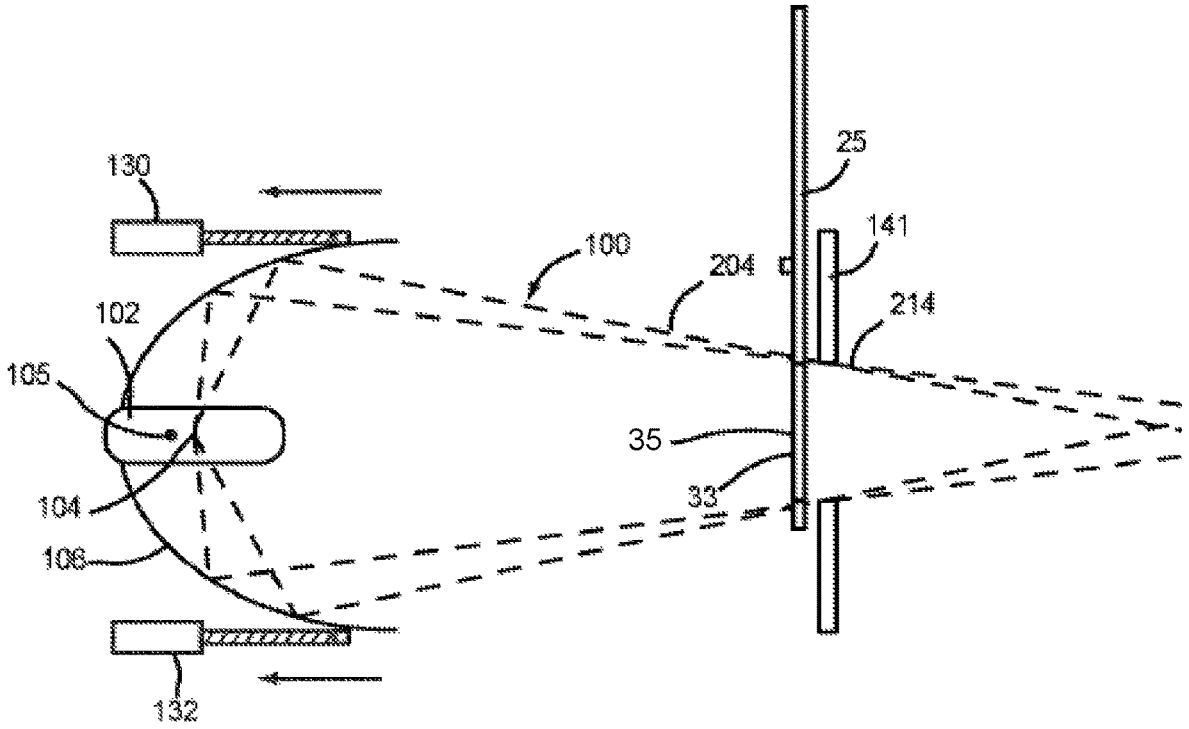
FIG. 24 shows the optical system of FIG. 22 with the reflector and the gobo wheel in a third configuration.

FIGS. 22, 23, and 24 show an optical system 100 according to the disclosure where a position of the ellipsoidal reflector 106 may be based on the insertion and removal of a gobo or other heat sensitive optical device into the light beam, to avoid damaging the gobo or optical device. FIG. 22 shows an optical system 100 according to the disclosure with a ellipsoidal reflector 106 and a gobo wheel 25 in a first configuration. The optical system 100 is shown in a peaked position where the light source 102 is positioned with its emission point 104 behind the first focal point 105 of the ellipsoidal reflector 106. Light beam 200 is directed through an open aperture 26 of gobo wheel 25 and is thus an unmodified beam. Light beam 200 has a peaked beam distribution with a hotspot at 212. As the open aperture 26 is in the beam there is no heat sensitive optical device into the light beam 200 and an operator may safely utilize the high output of the peaked beam.

FIG. 23 shows the optical system 100 with the ellipsoidal reflector 106 and the gobo wheel 25 in a second configuration. The gobo wheel 25 has been rotated to position a gobo 33 in the light beam 202, producing a modified beam. As the position of the ellipsoidal reflector 106 remains unchanged from the position shown in FIG. 22, the peaked light distribution of the light beam 202 with the pronounced hotspot 212 could damage the gobo 33 by local overheating at its center point 35.

FIG. 24 shows the optical system 100 with the ellipsoidal reflector 106 and the gobo wheel 25 in a third configuration that may reduce or prevent such damage. Motors 130 and 132 have been activated to move ellipsoidal reflector 106 rearwards so that the emission point 104 of the light source 102 is positioned in front of the first focal point 105 of the ellipsoidal reflector 106. In this position, light is directed in a wider, flatter beam with light distributed (214) across the whole of gobo 33, reducing both the beam's hotspot and overheating at center point 35.

As discussed with reference to FIGS. 16 and 19, a reduced hotspot intensity may also be found at locations in a light beam that are nearer to or farther from the light source than the second focal point of an ellipsoidal reflector, when the light beam is formed by a light source and ellipsoidal reflector in the configuration shown in FIGS. 16 and 19, e.g., the combined light source comprising light source 32 and reflector 30 as described with reference to FIGS. 3-5. Thus, in other embodiments of the disclosure, such a combined light source may be moved toward or away from a gobo or other optical device in the light beam to move the second focal point of the combined light source away from the optical device to reduce the effect of the beam's hotspot and the potential for overheating the optical device.

In some embodiments, movement of the ellipsoidal reflector 106 to the flat field position shown in FIG. 24 (or movement of occurs automatically by, for example, motor control firmware recognizing that the gobo wheel 25 has been rotated to position gobo 33 across the beam. In such embodiments, the ellipsoidal reflector 106 may automatically return to the forward, peaked position shown in FIGS. 22 and 23 when the gobo wheel 25 is rotated back to the open aperture position and the gobo 33 is removed from the beam. In other embodiments, such control of the movement of the ellipsoidal reflector 106 to protect heat sensitive optical devices may be performed manually by an operator or by software in a remote control desk. An operator may also choose to override such protection and position the ellipsoidal reflector 106 manually.

In further embodiments, automatic movement of the ellipsoidal reflector 106 to the flat field position shown in FIG. 24 may be used to protect other thermally sensitive optical devices, such as dichroic filters, irises, graphic wheels, automation wheels, prisms, lenses, or other devices.

In some embodiments, automatic movement of the ellipsoidal reflector 106 to the flat field position shown in FIG. 24 may be used to protect the hot mirror 48 or diffuser 50 of the heat protection and compensation module 34. A preset specified position for the ellipsoidal reflector 106 may be preprogrammed into the system of the automated luminaire and the ellipsoidal reflector 106 moved automatically to the preset position when the hot mirror 48 or diffuser 50 is moved into the beam. In some such embodiments, the preset position may be overwritten by an operator or by software in a remote control desk. A system according to the disclosure may provide separate, individual preset positions for the hot mirror 48 and the diffuser 50.

In some embodiments, an operator is able to program whether the system automatically moves to the preset position of ellipsoidal reflector 106 or oscillates the hot mirror 48 or diffuser 50, as described with reference to FIGS. 10 and 11. In such embodiments, the flow chart of FIG. 12 may be modified to permit the additional protection modes described herein.

In still other embodiments, the system may dictate that whenever the gobo wheel is moved into a non-open gobo position, a preset selection of diffuser 50, ellipsoidal reflector 106 position, or combination of diffuser 50 and ellipsoidal reflector 106 position is automatically employed to protect the engaged gobo. A preset position for the ellipsoidal reflector 106 used alone may be different than a preset position for the combination of reflector position and homogenizer. For an individual gobo, or for a particular use of a gobo, an operator may specify whether the diffuser 50, a ellipsoidal reflector 106 position, or a combination of diffuser 50 and ellipsoidal reflector 106 position is automatically engaged.

Figure 25:
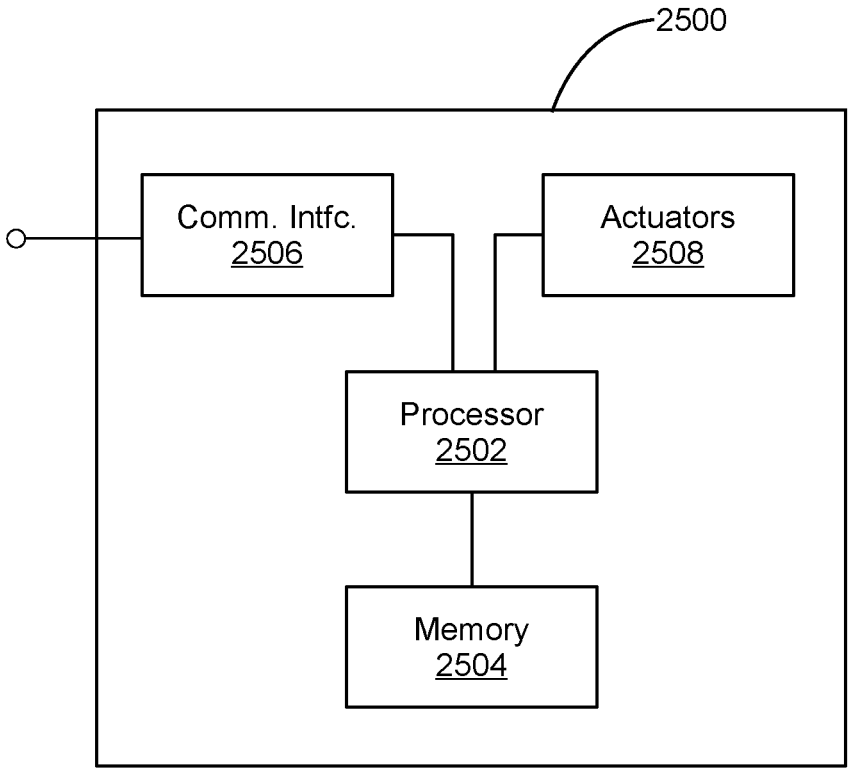
FIG. 25 presents a block diagram of a control system for an automated luminaire according to the disclosure.

FIG. 25 presents a block diagram of a control system (or controller) 2500 for an automated luminaire according to the disclosure. The control system 2500 includes a processor 2502 coupled to a memory 2504. The processor 2502 is implemented by hardware and software. The processor 2502 may be implemented as one or more CPU chips, cores (e.g., as a multi-core processor), field-programmable gate arrays (FPGAs), application specific integrated circuits (ASICs), and digital signal processors (DSPs). The processor 2502 is further electrically coupled to and in communication with a communication interface 2506 and one or more actuators 2508.

The control system 2500 is suitable for implementing processes, motor control, and other functionality as disclosed herein. Such processes, motor control, and other functionality may be implemented as instructions stored in the memory 2504 and executed by the processor 2502.

The memory 2504 comprises one or more disks, tape drives, and/or solid-state drives and may be used as an over-flow data storage device, to store programs when such programs are selected for execution, and to store instructions and data that are read during program execution. The memory 2504 may be volatile and/or non-volatile and may be read-only memory (ROM), random access memory (RAM), ternary content-addressable memory (TCAM), and/or static random-access memory (SRAM).

Figure 26:
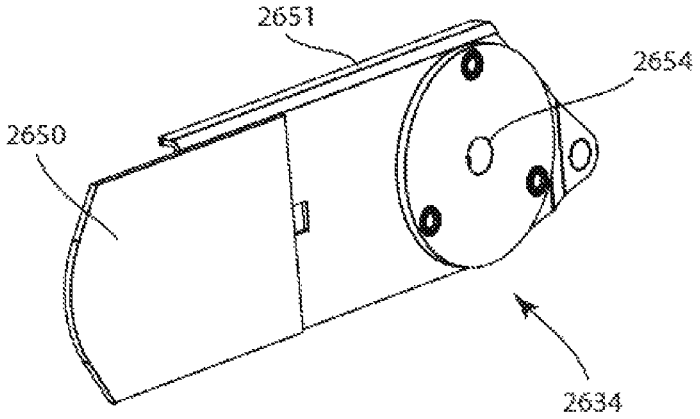
FIG. 26 presents an isometric view of a second embodiment of a compensation module according to the disclosure.
Figure 27:
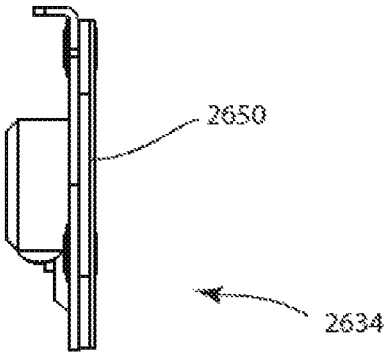
FIG. 27 presents a side view of the compensation module of FIG. 26.

FIG. 26 presents an isometric view of a second embodiment of a compensation module 2634 according to the disclosure. FIG. 27 presents a side view of the compensation module 2634 of FIG. 26. In this embodiment, a diffuser 2650 is mounted to an arm 2651 that has an axis of rotation 2654. The diffuser 2650 may be constructed of a single substrate as shown in FIGS. 26 and 27, or may comprise two or more layers. In some embodiments, the diffuser 2650 may be a single substrate with a hot mirror coating on one of its surfaces so as to also act as a hot mirror as well as a diffuser. In other embodiments, the diffuser 2650 may comprise two or more substrates, of which at least a first substrate is a diffuser or homogenizer and at least a second substrate is a hot mirror.

It will be understood that, in some embodiments, the compensation module 2634 is used in the optical system 300 in place of the compensation module 34. It will be understood that the technique of oscillating the diffuser 2650 between first and second positions in the beam (as described with reference to FIGS. 10 and 11) may be used to reduce the effect of the heat energy of the beam on the diffuser 2650.

Figure 28:
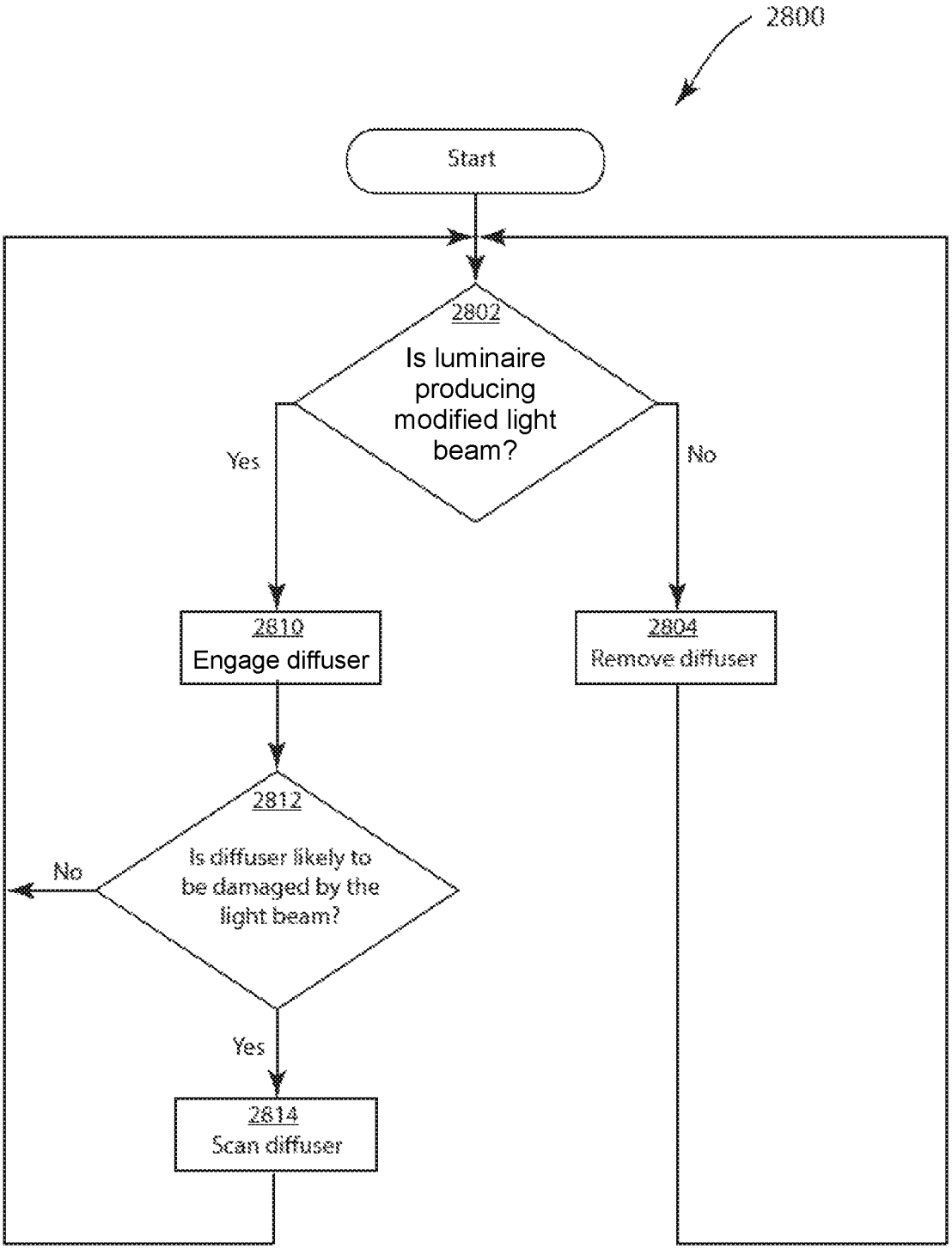
FIG. 28 presents a flow chart of a second process of controlling a heat protection and homogenization system according to the disclosure.

FIG. 28 presents a flow chart 2800 of a second process of controlling a heat protection and homogenization system according to the disclosure. The flow chart 2800 describes logic for protecting heat sensitive optical elements of an automated luminaire. The process described by the flow chart 2800 may be performed by the control system described below with reference to FIG. 25.

When the automated luminaire is on, the system monitors whether the luminaire is producing a modified light beam, for example, by placing a heat sensitive optical element in the light beam (step 2802). If the system determines that the luminaire is not producing a modified light beam (or if the beam is modified by an optical element that is not heat sensitive) the diffuser 2650 is removed from the light beam (step 2804).

If the system determines that the luminaire is producing a modified light beam (step 2802), then the diffuser 2650 is positioned in the light beam (step 2810). The system then monitors the operation of the luminaire to determine whether the status of the luminaire may cause risk of damage to the diffuser 2650 (step 2812). If so, the diffuser 2650 is scanned as described with reference to FIGS. 10 and 11 (step 2814). In determining a risk of damage, the system may consider, how long the diffuser 2650 has been engaged, how long it is expected to be engaged given preprogramed lighting instructions, fixture temperature, ambient temperature, and/or other factors. In other embodiments, the logic can dictate that whenever the luminaire optical elements are repositioned to produce a modified light beam, the diffuser 2650 is selected to engage the light beam and, if needed, is scanned.

While the disclosure has been described with respect to a limited number of embodiments, those skilled in the art, having benefit of this disclosure, will appreciate that other embodiments may be devised which do not depart from the scope of the disclosure herein. The disclosure has been described in detail, it should be understood that various changes, substitutions and alterations can be made hereto without departing from the spirit and scope of the disclosure.

What is claimed is:

1. An automated luminaire, comprising:

a light source;

an ellipsoidal reflector optically coupled to the light source and configured to produce an emitted light beam, the ellipsoidal reflector having an optical axis and being further configured to move relative to the light source along the optical axis;

a compensation module optically coupled to the ellipsoidal reflector, the compensation module comprising a homogenizing filter;

an optical device optically coupled to the compensation module and configured to produce one of a modified light beam and an unmodified light beam; and a controller configured to:

store an operator specification indicating whether the homogenizing filter is to be moved into the emitted light beam, the ellipsoidal reflector is to be moved to a selected position relative to the light source, or a combination of homogenizing filter and ellipsoidal reflector positions are to be used when the optical device is producing the modified beam; and determine whether the optical device is producing the modified beam or the unmodified light beam and, in response to determining that the optical device is producing the modified light beam, to move the ellipsoidal reflector to the selected position relative to the light source and/or position the homogenizing filter in the emitted light beam, according to the operator specification.

2. The automated luminaire of claim 1, wherein the selected ellipsoidal reflector position is a first selected position and the controller is further configured to move the ellipsoidal reflector to a second selected position in response to determining that the optical device is producing the unmodified light beam.

3. The automated luminaire of claim 2, wherein an intensity in a center of the emitted light beam is lower in the first selected position of the elliptical reflector than in the second selected position of the elliptical reflector.

4. The automated luminaire of claim 1, wherein the optical device comprises an iris and the controller is further configured to select the selected position based on an aperture size of the iris.

5. The automated luminaire of claim 4, wherein the controller is further configured to move the iris to a desired size and to determine the selected position of the ellipsoidal reflector based on light output through the iris.

6. The automated luminaire of claim 1, wherein:

the compensation module further comprises a hot mirror;

the operator specification indicates whether the hot mirror or the homogenizing filter or neither the hot mirror nor the homogenizing filter is to be moved into the emitted light beam; and the controller is configured to move either or neither of the homogenizing filter and the hot mirror into the emitted light beam in response to determining that the optical device is producing the modified light beam, according to the operator specification.

7. The automated luminaire of claim 1, wherein:

the optical device comprises first and second gobos and is configured to produce the modified light beam by positioning a selected one of the first and second gobos in a light beam received from the compensation module; and the controller is configured to:

store a first operator specification associated with the first gobo;

store a second operator specification associated with the second gobo; and determine whether the optical device is producing the modified beam using the first or second gobo and, in response, move the ellipsoidal reflector to the selected position relative to the light source and/or position the homogenizing filter in the emitted light beam, according to the associated first or second operator specification.

8. A method for use in an automated luminaire, the method comprising:

storing, by a processor, an operator specification indicating whether an ellipsoidal reflector is to be moved to a selected position relative to a light source, a homogenizing filter is to be moved into an emitted light beam produced by the light source and ellipsoidal reflector, or a combination of ellipsoidal reflector and homogenizing filter positions are to be used when an optical device of the automated luminaire is producing a modified beam;

determining, by the processor, whether the optical device is producing a modified or unmodified light beam from a light beam received by the optical device; and reducing, by the processor, an effect on the optical device of a hotspot in the light beam received by the optical device by moving the ellipsoidal reflector to the selected position relative to the light source and/or moving the homogenizing filter into the emitted light beam, according to the stored operator specification, in response to determining that the optical device is producing the modified light beam.

9. The method of claim 8, wherein the selected ellipsoidal reflector position is a first selected position, the method further comprising moving, by the processor, the ellipsoidal reflector to a second selected position in response to determining that the optical device is producing the unmodified light beam.

10. The method of claim 8, further comprising moving, by the processor, the ellipsoidal reflector to the selected position relative to the light source, the position selected based on a size of a variable aperture.

11. The method of claim 10, wherein the variable aperture comprises an iris, and wherein the method further comprises moving, by the processor, the iris to a desired size, and determining, by the processor, the selected position of the ellipsoidal reflector based on light output through the iris.

12. The method of claim 8, wherein:

the operator specification indicates whether a hot mirror or the homogenizing filter or neither the hot mirror nor the homogenizing filter is to be moved into the emitted light beam; and reducing the effect on the optical device of the hotspot in the light beam received by the optical device includes moving either or neither of the homogenizing filter and the hot mirror into the emitted light beam, according to the operator specification.

13. The method of claim 8, wherein:

storing an operator specification comprises storing a first operator specification and storing a second operator specification;

determining whether the optical device is producing a modified or unmodified light beam comprises determining whether the optical device is producing a modified light beam using a first gobo or a second gobo; and reducing the effect on the optical device of the hotspot in the light beam received by the optical device includes moving the ellipsoidal reflector to the selected position relative to the light source and/or moving the homogenizing filter into the emitted light beam, according to the stored first or second operator specification in response to determining that the optical device is producing the modified light beam using the first gobo or second gobo, respectively.

14. An automated luminaire, comprising:

a light source configured to produce an emitted light beam, the light source comprising an ellipsoidal reflector and a short arc discharge lamp fixedly mounted with the arc positioned near a first focus of the ellipsoidal reflector, the light source having an optical axis and being configured to move along the optical axis;

a compensation module optically coupled to the ellipsoidal reflector, the compensation module comprising a homogenizing filter;

an optical device optically coupled to the compensation module and configured to produce one of a modified light beam and an unmodified light beam; and a controller configured to:

store an operator specification indicating whether the homogenizing filter is to be moved into the emitted light beam, the light source is to be moved to a selected position on the optical axis, or a combination of homogenizing filter and light source positions are to be used when the optical device is producing the modified beam; and determine whether the optical device is producing the modified beam or the unmodified light beam and, in response to determining that the optical device is producing the modified light beam, move the light source to the selected position on the optical axis and/or position the homogenizing filter in the emitted light beam, according to the operator specification.

15. The automated luminaire of claim 14, wherein the selected position of the light source is a first selected position and the controller is further configured to move the light source to a second selected position on the optical axis in response to determining that the optical device is producing the unmodified light beam.

16. The automated luminaire of claim 15, wherein an intensity in a center of the emitted light beam is lower in the first selected position than in the second selected position.

17. The automated luminaire of claim 14, wherein:

the compensation module further comprises a hot mirror;

the operator specification indicates whether the hot mirror or the homogenizing filter or neither the hot mirror nor the homogenizing filter is to be positioned in the emitted light beam; and the controller is configured to move either or neither of the homogenizing filter and the hot mirror into the emitted light beam in response to determining that the optical device is producing the modified light beam, according to the operator specification.

18. The automated luminaire of claim 14, wherein:

the optical device comprises first and second gobos and is configured to produce the modified light beam by positioning a selected one of the first and second gobos in a light beam received from the compensation module; and the controller is configured to:

store a first operator specification associated with the first gobo;

store a second operator specification associated with the second gobo; and determine whether the optical device is producing the modified beam using the first or second gobo and, in response, move the light source to the selected position on the optical axis and/or position the homogenizing filter in the emitted light beam, according to the associated first or second operator specification.

* * * * *